US007884813B2

(12) United States Patent
Seki

(10) Patent No.: US 7,884,813 B2
(45) Date of Patent: Feb. 8, 2011

(54) APPARATUS AND METHOD FOR DRIVING SELF-LUMINESCENT DISPLAY PANEL

(75) Inventor: Shuichi Seki, Yonezawa (JP)

(73) Assignee: Tohoku Pioneer Corporation, Tendo (JP)

( * ) Notice: Subject to any disclaimer, the term of this patent is extended or adjusted under 35 U.S.C. 154(b) by 988 days.

(21) Appl. No.: 11/375,193

(22) Filed: Mar. 15, 2006

(65) Prior Publication Data

US 2006/0221008 A1 Oct. 5, 2006

(30) Foreign Application Priority Data

Mar. 31, 2005 (JP) ..... 2005-101341

(51) Int. Cl.

| | |
|---|---|
| ***G09G 3/30*** | (2006.01) |
| ***G09G 5/00*** | (2006.01) |
| ***G09G 5/10*** | (2006.01) |
| ***G06F 3/038*** | (2006.01) |

(52) U.S. Cl. ..... 345/204; 345/690; 345/76

(58) Field of Classification Search ..... 345/204
See application file for complete search history.

(56) References Cited

U.S. PATENT DOCUMENTS

| | | | | |
|---|---|---|---|---|
| 6,052,112 | A * | 4/2000 | Tanaka et al. | 345/596 |
| 6,069,609 | A * | 5/2000 | Ishida et al. | 345/596 |
| 6,191,764 | B1 * | 2/2001 | Kono et al. | 345/76 |
| 6,831,618 | B1 * | 12/2004 | Suzuki et al. | 345/60 |
| 2002/0036603 | A1 * | 3/2002 | Nagakubo et al. | 345/60 |
| 2003/0011540 | A1 * | 1/2003 | Tokunaga et al. | 345/60 |
| 2004/0130560 | A1 * | 7/2004 | Matsueda et al. | 345/692 |
| 2005/0069209 | A1 * | 3/2005 | Damera-Venkata et al. | 382/204 |
| 2005/0259089 | A1 * | 11/2005 | Yamazaki et al. | 345/204 |

FOREIGN PATENT DOCUMENTS

| | | |
|---|---|---|
| JP | 2001-125529 | 5/2001 |

* cited by examiner

*Primary Examiner*—Alexander S Beck
(74) *Attorney, Agent, or Firm*—Westerman, Hattori, Daniels & Adrian, LLP

(57) ABSTRACT

An apparatus for driving a self-luminescent display panel is provided with a plurality of luminescent elements 14 that are arranged at intersection positions of a plurality of data lines and a plurality of scanning lines. One frame period is time-divided into N subframe periods (N is a positive integer). A gradation display is set by an accumulated sum of one or plural lighting control periods. The apparatus is provided with first gradation control means (21, 24, 25, 26, 30) for lighting at least two other subframe periods at a brightness level a in addition to subframe periods lit at a brightness level a−1, assuming that a is an integer satisfying 0<a<N.

16 Claims, 25 Drawing Sheets

CASE OF DIVISION INTO 32 SUBFRAMES WITHOUT GAMMA CORRECTION

DITHER MASK A

DITHER MASK B

Fig. 14A

| AVERAGE GRADATION | 1.25 | 1.5 (REAL GRADATION) | 1.75 | 2.0 |
|---|---|---|---|---|
| POSSIBLE GRADATIONS IN EACH PIXEL | p: 1.5, 1.5; q: 1.5, 1.5; r: 0.5, 1.5; s: 1.5, 1.5 | p: 1.5, 1.5; q: 1.5, 1.5; r: 1.5, 1.5; s: 1.5, 1.5 | p: 2.5, 1.5; q: 1.5, 1.5; r: 1.5, 1.5; s: 1.5, 1.5 | p: 2.5, 1.5; q: 1.5, 2.5; r: 1.5, 2.5; s: 1.5, 2.5 |

Fig. 14B

| AVERAGE GRADATION | 2.25 | 2.5 | 2.75 | 3.0 (REAL GRADATION) |
|---|---|---|---|---|
| POSSIBLE GRADATIONS IN EACH PIXEL | p: 2, 2; q: 2, 2; r: 3, 2; s: 2, 2 | p: 2, 3; q: 3, 2; r: 3, 2; s: 3, 2 | p: 2, 3; q: 3, 3; r: 3, 3; s: 3, 3 | p: 3, 3; q: 3, 3; r: 3, 3; s: 3, 3 |

DITHER MASK A

DITHER MASK B

DITHER MASK C

DITHER MASK D

Fig. 17

29

| PIXEL DATA | HD | | | | | | | | | | | | | | | SF(SUBFRAME) | | | | | | | | | | | | | | |
|---|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 1 | 2 | 3 | 4 | 5 | 6 | 7 | 8 | | 27 | 28 | 29 | 30 | 31 | 32 |
| 0 | 0 | 0 | 0 | 0 | 0 | 0 | 0 | 0 | 0 | 0 | 0 | 0 | 0 | 0 | 0 | | | | | | | | | | | | | | | |
| 1 | 1 | 0 | 0 | 0 | 0 | 0 | 0 | 0 | 0 | 0 | 0 | 0 | 0 | 0 | 0 | ○ | ○ | | | | | | | | | | | | | |
| 2 | 1 | 1 | 0 | 0 | 0 | 0 | 0 | 0 | 0 | 0 | 0 | 0 | 0 | 0 | 0 | ○ | ○ | ○ | ○ | | | | | | | | | | | |
| 3 | 1 | 1 | 1 | 0 | 0 | 0 | 0 | 0 | 0 | 0 | 0 | 0 | 0 | 0 | 0 | ○ | ○ | ○ | ○ | ○ | ○ | | | | | | | | | |
| 4 | 1 | 1 | 1 | 1 | 0 | 0 | 0 | 0 | 0 | 0 | 0 | 0 | 0 | 0 | 0 | ○ | ○ | ○ | ○ | ○ | ○ | ○ | ○ | | | | | | | |
| 5 | 1 | 1 | 1 | 1 | 1 | 0 | 0 | 0 | 0 | 0 | 0 | 0 | 0 | 0 | 0 | ○ | ○ | ○ | ○ | ○ | ○ | ○ | ○ | | | | | | | |
| 6 | 1 | 1 | 1 | 1 | 1 | 1 | 0 | 0 | 0 | 0 | 0 | 0 | 0 | 0 | 0 | ○ | ○ | ○ | ○ | ○ | ○ | ○ | ○ | | | | | | | |
| 7 | 1 | 1 | 1 | 1 | 1 | 1 | 1 | 0 | 0 | 0 | 0 | 0 | 0 | 0 | 0 | ○ | ○ | ○ | ○ | ○ | ○ | ○ | ○ | | | | | | | |
| 8 | 1 | 1 | 1 | 1 | 1 | 1 | 1 | 1 | 0 | 0 | 0 | 0 | 0 | 0 | 0 | ○ | ○ | ○ | ○ | ○ | ○ | ○ | ○ | | | | | | | |
| 9 | 1 | 1 | 1 | 1 | 1 | 1 | 1 | 1 | 1 | 0 | 0 | 0 | 0 | 0 | 0 | ○ | ○ | ○ | ○ | ○ | ○ | ○ | ○ | | | | | | | |
| 10 | 1 | 1 | 1 | 1 | 1 | 1 | 1 | 1 | 1 | 1 | 0 | 0 | 0 | 0 | 0 | ○ | ○ | ○ | ○ | ○ | ○ | ○ | ○ | | | | | | | |
| 11 | 1 | 1 | 1 | 1 | 1 | 1 | 1 | 1 | 1 | 1 | 1 | 0 | 0 | 0 | 0 | ○ | ○ | ○ | ○ | ○ | ○ | ○ | ○ | | | | | | | |
| 12 | 1 | 1 | 1 | 1 | 1 | 1 | 1 | 1 | 1 | 1 | 1 | 1 | 0 | 0 | 0 | ○ | ○ | ○ | ○ | ○ | ○ | ○ | ○ | | | | | | | |
| 13 | 1 | 1 | 1 | 1 | 1 | 1 | 1 | 1 | 1 | 1 | 1 | 1 | 1 | 0 | 0 | ○ | ○ | ○ | ○ | ○ | ○ | ○ | ○ | | | | | | | |
| 14 | 1 | 1 | 1 | 1 | 1 | 1 | 1 | 1 | 1 | 1 | 1 | 1 | 1 | 1 | 0 | ○ | ○ | ○ | ○ | ○ | ○ | ○ | ○ | | ○ | ○ | | | | |
| 15 | 1 | 1 | 1 | 1 | 1 | 1 | 1 | 1 | 1 | 1 | 1 | 1 | 1 | 1 | 1 | ○ | ○ | ○ | ○ | ○ | ○ | ○ | ○ | | ○ | ○ | ○ | ○ | ○ | ○ |

○ : LUMINESCENT

Fig. 19

33

| PIXEL DATA | HD | | | | | | | | | | | | | | | SF (SUBFRAME) | | | | | | | | | | | | | | | |
|---|---|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 1 | 2 | 3 | 4 | 5 | 6 | 7 | 8 | 9 | 10 | 11 | 12 | 13 | 14 | 15 | 16 |
| 0 | 0 | 0 | 0 | 0 | 0 | 0 | 0 | 0 | 0 | 0 | 0 | 0 | 0 | 0 | 0 | | | | | | | | | | | | | | | | |
| 1 | 1 | 0 | 0 | 0 | 0 | 0 | 0 | 0 | 0 | 0 | 0 | 0 | 0 | 0 | 0 | | | | | | | | | | | | | | | | |
| 2 | 1 | 1 | 0 | 0 | 0 | 0 | 0 | 0 | 0 | 0 | 0 | 0 | 0 | 0 | 0 | ○ | ○ | | | | | | | | | | | | | | |
| 3 | 1 | 1 | 1 | 0 | 0 | 0 | 0 | 0 | 0 | 0 | 0 | 0 | 0 | 0 | 0 | ○ | ○ | | | | | | | | | | | | | | |
| 4 | 1 | 1 | 1 | 1 | 0 | 0 | 0 | 0 | 0 | 0 | 0 | 0 | 0 | 0 | 0 | ○ | ○ | ○ | ○ | | | | | | | | | | | | |
| 5 | 1 | 1 | 1 | 1 | 1 | 0 | 0 | 0 | 0 | 0 | 0 | 0 | 0 | 0 | 0 | ○ | ○ | ○ | ○ | | | | | | | | | | | | |
| 6 | 1 | 1 | 1 | 1 | 1 | 1 | 0 | 0 | 0 | 0 | 0 | 0 | 0 | 0 | 0 | ○ | ○ | ○ | ○ | ○ | ○ | | | | | | | | | | |
| 7 | 1 | 1 | 1 | 1 | 1 | 1 | 1 | 0 | 0 | 0 | 0 | 0 | 0 | 0 | 0 | ○ | ○ | ○ | ○ | ○ | ○ | | | | | | | | | | |
| 8 | 1 | 1 | 1 | 1 | 1 | 1 | 1 | 1 | 0 | 0 | 0 | 0 | 0 | 0 | 0 | ○ | ○ | ○ | ○ | ○ | ○ | ○ | ○ | | | | | | | | |
| 9 | 1 | 1 | 1 | 1 | 1 | 1 | 1 | 1 | 1 | 0 | 0 | 0 | 0 | 0 | 0 | ○ | ○ | ○ | ○ | ○ | ○ | ○ | ○ | | | | | | | | |
| 10 | 1 | 1 | 1 | 1 | 1 | 1 | 1 | 1 | 1 | 1 | 0 | 0 | 0 | 0 | 0 | ○ | ○ | ○ | ○ | ○ | ○ | ○ | ○ | ○ | ○ | | | | | | |
| 11 | 1 | 1 | 1 | 1 | 1 | 1 | 1 | 1 | 1 | 1 | 1 | 0 | 0 | 0 | 0 | ○ | ○ | ○ | ○ | ○ | ○ | ○ | ○ | ○ | ○ | | | | | | |
| 12 | 1 | 1 | 1 | 1 | 1 | 1 | 1 | 1 | 1 | 1 | 1 | 1 | 0 | 0 | 0 | ○ | ○ | ○ | ○ | ○ | ○ | ○ | ○ | ○ | ○ | ○ | ○ | | | | |
| 13 | 1 | 1 | 1 | 1 | 1 | 1 | 1 | 1 | 1 | 1 | 1 | 1 | 1 | 0 | 0 | ○ | ○ | ○ | ○ | ○ | ○ | ○ | ○ | ○ | ○ | ○ | ○ | | | | |
| 14 | 1 | 1 | 1 | 1 | 1 | 1 | 1 | 1 | 1 | 1 | 1 | 1 | 1 | 1 | 0 | ○ | ○ | ○ | ○ | ○ | ○ | ○ | ○ | ○ | ○ | ○ | ○ | ○ | ○ | | |
| 15 | 1 | 1 | 1 | 1 | 1 | 1 | 1 | 1 | 1 | 1 | 1 | 1 | 1 | 1 | 1 | ○ | ○ | ○ | ○ | ○ | ○ | ○ | ○ | ○ | ○ | ○ | ○ | ○ | ○ | | |

○ : LUMINESCENT

Fig. 20

35

| PIXEL DATA | HD | | | | | | | | | | | | | | | SF(SUBFRAME) | | | | | | | | | | | | | | | |
|---|---|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 1 | 2 | 3 | 4 | 5 | 6 | 7 | 8 | 9 | 10 | 11 | 12 | 13 | 14 | 15 | 16 |
| 0 | 0 | 0 | 0 | 0 | 0 | 0 | 0 | 0 | 0 | 0 | 0 | 0 | 0 | 0 | 0 | | | | | | | | | | | | | | | | |
| 1 | 1 | 0 | 0 | 0 | 0 | 0 | 0 | 0 | 0 | 0 | 0 | 0 | 0 | 0 | 0 | ○ | ○ | | | | | | | | | | | | | | |
| 2 | 1 | 1 | 0 | 0 | 0 | 0 | 0 | 0 | 0 | 0 | 0 | 0 | 0 | 0 | 0 | ○ | ○ | | | | | | | | | | | | | | |
| 3 | 1 | 1 | 1 | 0 | 0 | 0 | 0 | 0 | 0 | 0 | 0 | 0 | 0 | 0 | 0 | ○ | ○ | ○ | ○ | | | | | | | | | | | | |
| 4 | 1 | 1 | 1 | 1 | 0 | 0 | 0 | 0 | 0 | 0 | 0 | 0 | 0 | 0 | 0 | ○ | ○ | ○ | ○ | | | | | | | | | | | | |
| 5 | 1 | 1 | 1 | 1 | 1 | 0 | 0 | 0 | 0 | 0 | 0 | 0 | 0 | 0 | 0 | ○ | ○ | ○ | ○ | ○ | ○ | | | | | | | | | | |
| 6 | 1 | 1 | 1 | 1 | 1 | 1 | 0 | 0 | 0 | 0 | 0 | 0 | 0 | 0 | 0 | ○ | ○ | ○ | ○ | ○ | ○ | | | | | | | | | | |
| 7 | 1 | 1 | 1 | 1 | 1 | 1 | 1 | 0 | 0 | 0 | 0 | 0 | 0 | 0 | 0 | ○ | ○ | ○ | ○ | ○ | ○ | ○ | ○ | | | | | | | | |
| 8 | 1 | 1 | 1 | 1 | 1 | 1 | 1 | 1 | 0 | 0 | 0 | 0 | 0 | 0 | 0 | ○ | ○ | ○ | ○ | ○ | ○ | ○ | ○ | | | | | | | | |
| 9 | 1 | 1 | 1 | 1 | 1 | 1 | 1 | 1 | 1 | 0 | 0 | 0 | 0 | 0 | 0 | ○ | ○ | ○ | ○ | ○ | ○ | ○ | ○ | ○ | ○ | | | | | | |
| 10 | 1 | 1 | 1 | 1 | 1 | 1 | 1 | 1 | 1 | 1 | 0 | 0 | 0 | 0 | 0 | ○ | ○ | ○ | ○ | ○ | ○ | ○ | ○ | ○ | ○ | | | | | | |
| 11 | 1 | 1 | 1 | 1 | 1 | 1 | 1 | 1 | 1 | 1 | 1 | 0 | 0 | 0 | 0 | ○ | ○ | ○ | ○ | ○ | ○ | ○ | ○ | ○ | ○ | ○ | ○ | | | | |
| 12 | 1 | 1 | 1 | 1 | 1 | 1 | 1 | 1 | 1 | 1 | 1 | 1 | 0 | 0 | 0 | ○ | ○ | ○ | ○ | ○ | ○ | ○ | ○ | ○ | ○ | ○ | ○ | | | | |
| 13 | 1 | 1 | 1 | 1 | 1 | 1 | 1 | 1 | 1 | 1 | 1 | 1 | 1 | 0 | 0 | ○ | ○ | ○ | ○ | ○ | ○ | ○ | ○ | ○ | ○ | ○ | ○ | ○ | ○ | | |
| 14 | 1 | 1 | 1 | 1 | 1 | 1 | 1 | 1 | 1 | 1 | 1 | 1 | 1 | 1 | 0 | ○ | ○ | ○ | ○ | ○ | ○ | ○ | ○ | ○ | ○ | ○ | ○ | ○ | ○ | | |
| 15 | 1 | 1 | 1 | 1 | 1 | 1 | 1 | 1 | 1 | 1 | 1 | 1 | 1 | 1 | 1 | ○ | ○ | ○ | ○ | ○ | ○ | ○ | ○ | ○ | ○ | ○ | ○ | ○ | ○ | ○ | ○ |

○ : LUMINESCENT

Fig. 21A

DITHER MASK A

| | | |
|---|---|---|
| 0 | 1 | 2 |
| 3 | 4 | 5 |
| 6 | 7 | 8 |

DITHER MASK B

| | | |
|---|---|---|
| 8 | 7 | 6 |
| 5 | 4 | 3 |
| 2 | 1 | 0 |

Fig. 21B

DITHER MASK A

| | | | |
|---|---|---|---|
| 0 | 1 | 2 | 3 |
| 4 | 5 | 6 | 7 |
| 8 | 9 | 10 | 11 |
| 12 | 13 | 14 | 15 |

DITHER MASK B

| | | | |
|---|---|---|---|
| 15 | 14 | 13 | 12 |
| 11 | 10 | 9 | 8 |
| 7 | 6 | 5 | 4 |
| 3 | 2 | 1 | 0 |

APPARATUS AND METHOD FOR DRIVING SELF-LUMINESCENT DISPLAY PANEL

BACKGROUND OF THE INVENTION

1. Field of the Invention

The present invention relates to an apparatus and a method for driving a self-luminescent display panel that performs gradation expression by time-dividing one frame period into a plurality of subframe periods, and controlling the lighting of each subframe period, as well as to an electronic appliance equipped with the driving apparatus.

2. Description of the Related Art

Development of displays using a display panel constituted by arranging luminescent elements in a matrix form is widely proceeding. As a luminescent element used for such a display panel, an organic EL (electroluminescence) element using an organic material in a luminescent layer, for example, is attracting people's attention.

As a display panel using such an organic EL element, there is an active matrix type display panel in which an active element made of a TFT (thin film transistor), for example, is added to each of the EL elements arranged in a matrix form. This active matrix type display panel can realize low electric power consumption, and also has properties such as less cross-talking between the pixels, so that it is suitable for a highly fine display constituting a large screen.

FIG. 1 shows one example of a circuit construction corresponding to one pixel 10 in a conventional active matrix type display panel. In FIG. 1, the gate G of a TFT 11, which is a transistor for control, is connected to a scanning line (scanning line A1), and the source S is connected to a data line (data line B1). Also, the drain D of this TFT 11 for control is connected to the gate G of a TFT 12, which is a transistor for driving, and is also connected to one terminal of a capacitor 13 for holding electric charge.

The drain D of the TFT 12 for driving is connected to the other terminal of the capacitor 13, and is connected to a common anode 16 formed within the panel. The source S of the TFT 12 for driving is connected to the anode of an organic EL element 14, and the cathode of this organic EL element 14 is connected to a common cathode 17 formed within the panel and constituting a standard potential point (ground), for example.

FIG. 2 is a model view showing a state in which the circuit constructions that are in charge of the pixels 10 shown in FIG. 1 are arranged on a display panel 20. At each of the intersection positions of the scanning lines A1 to An and the data lines B1 to Bm, each pixel 10 having a circuit construction shown in FIG. 1 is respectively formed. In the above-described construction, the drains of the TFT 12 for driving are connected to the common anode 16 shown in FIG. 2, and the cathodes of the EL elements 14 are connected to the common cathode 17 shown in FIG. 2. In performing a luminescence control in this circuit, a switch 18 is brought into a state of being connected to the ground, as shown in FIG. 2, whereby a voltage source +VD is supplied to the common anode 16.

When an on-voltage is supplied via a scanning line to the gate G of a TFT 11 for control in FIG. 1 in this state, the TFT 11 passes, from the source S to the drain D, an electric current corresponding to the voltage from the data line that is supplied to the source S. Therefore, during the period in which the gate G of the TFT 11 is at the on-voltage, the aforesaid capacitor 13 is charged, and that voltage is supplied to the gate G of the TFT 12 for driving. The TFT 12 passes an electric current based on the gate voltage and the drain voltage from the source S through the EL element 14 to the common cathode 17, so as to make the EL element 14 luminescent.

When the gate G of the TFT 11 is brought to an off-voltage, the TFT 11 will be in a so-called cut-off state, and the drain D of the TFT 11 will be in an open state. However, in the TFT 12 for driving, the electric charge stored in the capacitor 13 holds the voltage of the gate G and maintains the driving current till the next scanning, whereby the luminescence of the EL element 14 is also maintained. Here, since a gate input capacitance is present in the aforementioned TFT 12 for driving, an operation similar to the above-described one can be performed even if the aforesaid capacitor 13 is specially provided.

In the meantime, as a system that performs gradation display of image data by using a circuit construction such as described above, there is a time gradation system. This time gradation system is a system in which, for example, one frame period is time-divided into a plurality of subframe periods, and a half-tone (intermediate gradation) display is carried out by an accumulated sum of the subframe periods in which the organic EL element emitted light per one frame period.

Further, in this time gradation system, there are a system (which is referred to as simple subframe method for the sake of convenience) in which the EL element is made to emit light subframe by subframe, and the gradation expression is carried out by a simple accumulated sum of the luminescent subframe periods, as shown in FIG. 3, and a system (which is referred to as weighted subframe method for the sake of convenience) in which, by treating one or plural subframe periods as one set, the gradation bit is allotted to the set for weighting, and the gradation expression is carried out by a combination thereof, as shown in FIG. 4. Here, in FIGS. 3 and 4, an example is shown in which eight gradations from gradation 0 to gradation 7 are displayed.

Among these, the weighted subframe method provides an advantage in that a multiple gradation display can be realized with a smaller number of subframes than in the simple subframe method by performing weighting control for gradation display also to the lighting period in a subframe period. However, in this weighted subframe method, the gradation is expressed by a combination of luminescences that are discrete in the time direction on an image of one frame, so that a contour-like noise, which is called a pseudo-moving-picture outline noise (hereafter also referred to simply as pseudo outline noise) may be generated, and this is one factor for image quality deterioration. This pseudo-outline noise will be described with reference to FIG. 5. FIG. 5 is a view for describing a mechanism of pseudo-outline noise generation. In FIG. 5, description will be made by raising an example in which four sets of subframes (set 1 to set 4) that are weighted to the brightnesses of the powers of two (weight 1, 2, 4, 8) are arranged in the order of increasing brightness.

An image having a brightness elevated by one step pixel by pixel as it goes downwards in the display screen, namely an image with gradually changing brightness, is considered. Assume that this image goes upward for the distance of one pixel after one frame passes. As illustrated, frame 1 and frame 2 are shifted by one pixel in the display position on the screen. However, a human eye cannot perceive the discrepancy of this image movement.

However, since a human eye has a property of following a moving brightness, the eye follows a set of subframes that are not luminescent at a position between the brightness 7 and the brightness 8 at which the luminescence pattern changes greatly by carriage of digits, for example, so that the human eye perceives as if a black pixel having a brightness 0 is moving. Therefore, the human eye recognizes a brightness that is not inherently present, and this is perceived as a contour-like noise. Thus, in displaying the same gradation data at the same pixel in consecutive frames, the pseudo-outline noise is likely to be generated if the luminescence pattern in each frame is the same.

As a countermeasure to cope with such a problem, there is a method of changing the order of display of the sets of weighted subframes frame by frame. In the example shown in FIG. 6, in each of the two consecutive frames (referred to as the first frame and the second frame), the order of display of the weighted sets is made different. In other words, in the first frame, the display is made in the order of the sets of weight 4, weight 2, weight 1, whereas in the second frame, the display is made in the order of the sets of weight 1, weight 4, weight 2. This makes the luminescence pattern be different even with the same gradation data in consecutive frames, thereby restraining the generation of pseudo-outline noise to some extent.

Here, a gradation display having a devised luminescence pattern of one frame data for restraining the generation of pseudo-moving-picture outline noise is disclosed, for example, in Japanese Patent Application Laid-Open (JP-A) No. 2001-125529 (page 3, right column, line 45 to page 4, left column, line 9, FIG. 2) also.

In the method shown in FIG. 6, control is made so that the luminescence pattern may be different between consecutive frames in the same pixel, so that the perception of the pseudo-outline noise by human vision sense can be reduced to some extent. However, even if any devising is made, there will be no change in the principle of gradation expression by a combination of the luminescences that are discrete in the time direction in the weighted subframe method, so that it is not possible to restrain the generation of the pseudo-outline noise completely.

On the other hand, in the simple subframe method, the luminescence in plural subframe periods are not largely discrete in the luminescence of one frame period, so that the generation of pseudo-outline noise can be restrained to some extent. However, in the simple subframe method, gradation display is made by letting one or plural consecutive subframe periods be simply luminescent, so that one frame period must be divided into many subframe periods for realizing a multiple gradation display. In that case, the clock frequency must be set high, thereby raising a problem in that the load imposed upon the driving peripheral circuit becomes large.

Also, since an organic EL element is a current injection type luminescent element, the electric current that flows through the wiring resistance imposed upon the element is largely dependent on the ratio of lighting of the luminescent display panel. Namely, when a change is made to increase the ratio of lighting greatly, the amount of voltage fall of the wiring resistance increases, thereby generating a phenomenon such that the driving voltage of the element decreases and the luminescence brightness decreases. This phenomenon is more liable to occur in the weighted subframe method in which the ratio of lighting tends to change rapidly. In this case, there will be a problem in that the gradation display is destroyed, making it impossible to perform a normal gradation expression (generation of gradation abnormality).

SUMMARY OF THE INVENTION

The present invention has been made in view of the aforementioned technical problems of the prior art, and an object thereof is to provide an apparatus for driving a self-luminescent display panel that can perform multiple gradation display while restraining the generation of pseudo-moving-picture outline noise or gradation abnormality in the self-luminescent display panel having self-luminescent elements arranged in a matrix form, as well as an electronic appliance provided with the driving apparatus.

An apparatus for driving a self-luminescent display panel according to the invention made in order to solve the aforementioned problems is an apparatus for driving a self-luminescent display panel provided with a plurality of luminescent elements that are arranged at intersection positions of a plurality of data lines and a plurality of scanning lines, wherein one frame period is time-divided into N subframe periods (N is a positive integer), and a gradation display is set by an accumulated sum of one or plural lighting control periods, and the apparatus is provided with first gradation control means for lighting at least two other subframe periods at a brightness level a in addition to subframe periods lit at a brightness level a−1, assuming that a is an integer satisfying $0<a<N$.

Also, a method for driving a self-luminescent display panel according to the invention made in order to solve the aforementioned problems is a method for driving a self-luminescent display panel provided with a plurality of luminescent elements that are arranged at intersection positions of a plurality of data lines and a plurality of scanning lines, wherein one frame period is time-divided into N subframe periods (N is a positive integer), and a gradation display is set by an accumulated sum of one or plural lighting control periods, and the apparatus lights at least two other subframe periods at a brightness level a in addition to subframe periods lit at a brightness level a−1, assuming that a is an integer satisfying $0<a<N$.

BRIEF DESCRIPTION OF THE DRAWINGS

FIGS. 14A to 14C are views each showing an example of the gradation in each pixel and an average gradation in the four pixels in performing a dither processing using a set of four pixels;

FIG. 17 is a view showing one example of a data conversion table used in the data conversion means of FIG. 7;

FIG. 19 is a view showing one example of a data conversion table for the odd-numbered frames used in the data conversion means of FIG. 7 in the second embodiment according to the invention;

FIG. 20 is a view showing one example of a data conversion table for the even-numbered frames used in the data conversion means of FIG. 7 in the second embodiment according to the invention;

FIG. 21 is a view showing another example of a dither mask applicable to the embodiments of the invention.

DESCRIPTION OF THE PREFERRED EMBODIMENTS

Hereafter, an apparatus and a method for driving a self-luminescent display panel according to the invention will be described with reference to the embodiments shown in the attached drawings. Here, in the following description, the part corresponding to each section shown in FIGS. 1 and 2 already described above is denoted with the same symbol, and therefore description of individual functions and operations will be omitted at appropriate times.

Figure 1:
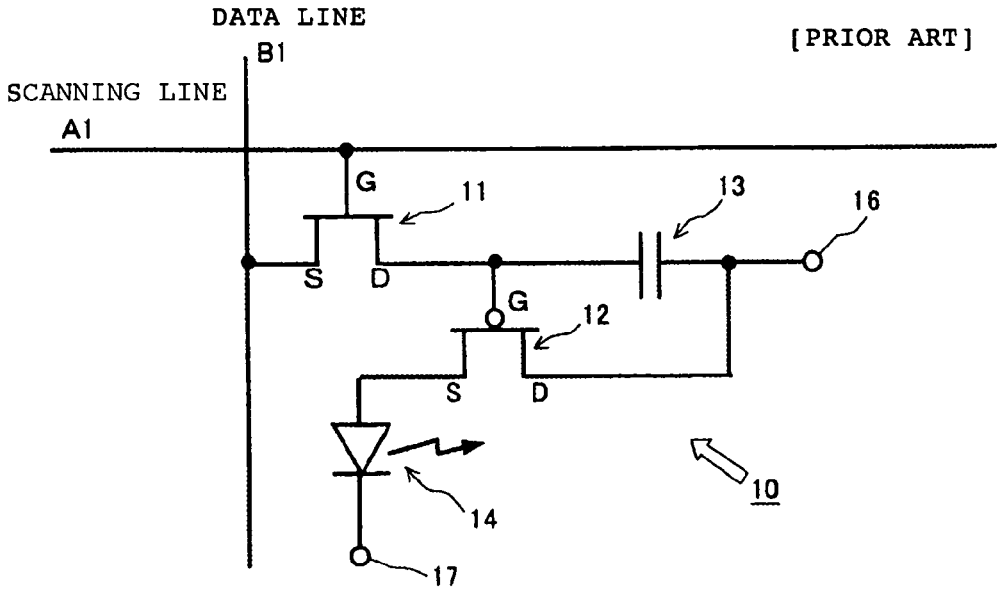
FIG. 1 is a view showing one example of a circuit construction corresponding to one pixel in a conventional active matrix type display panel.
Figure 2:
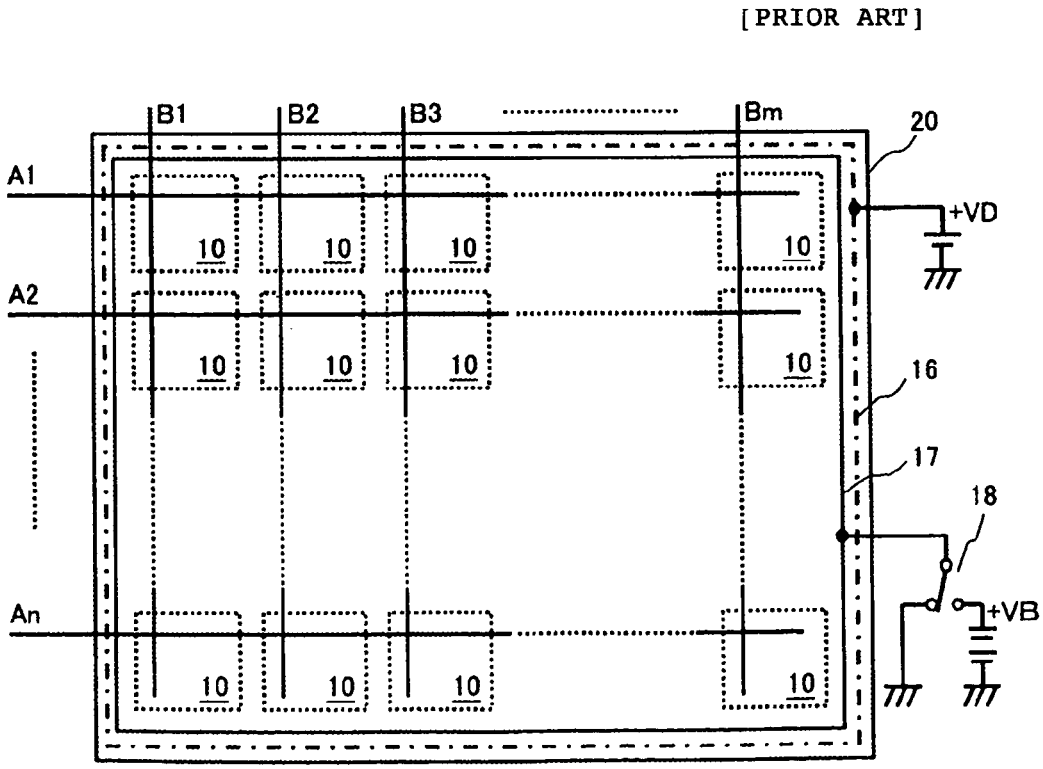
FIG. 2 is a model view showing a state in which the circuit constructions in charge of the respective pixels shown in FIG. 1 are arranged on a display panel.
Figure 3:
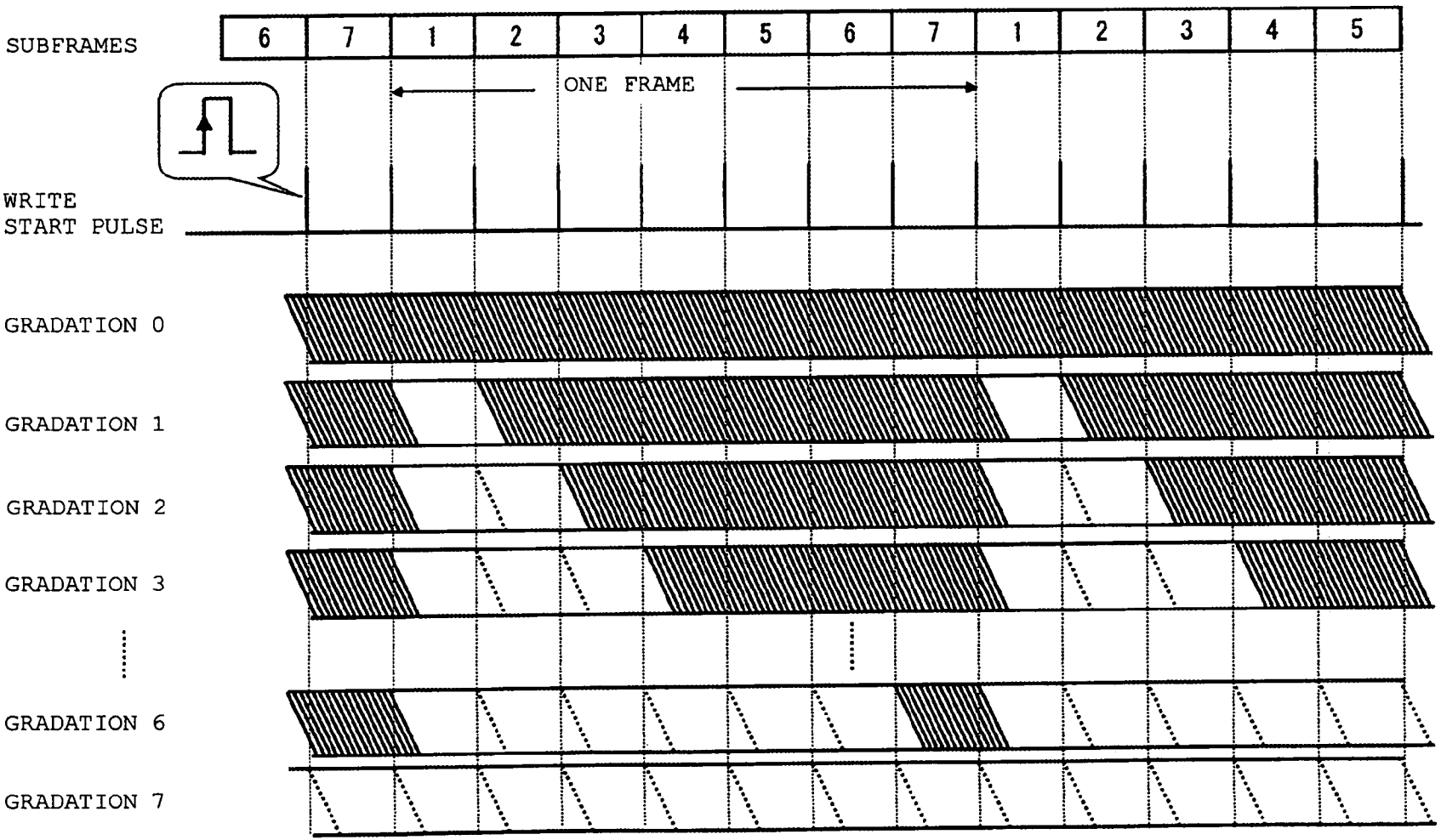
FIG. 3 is a timing chart for describing a simple subframe method in a time gradation system.
Figure 4:
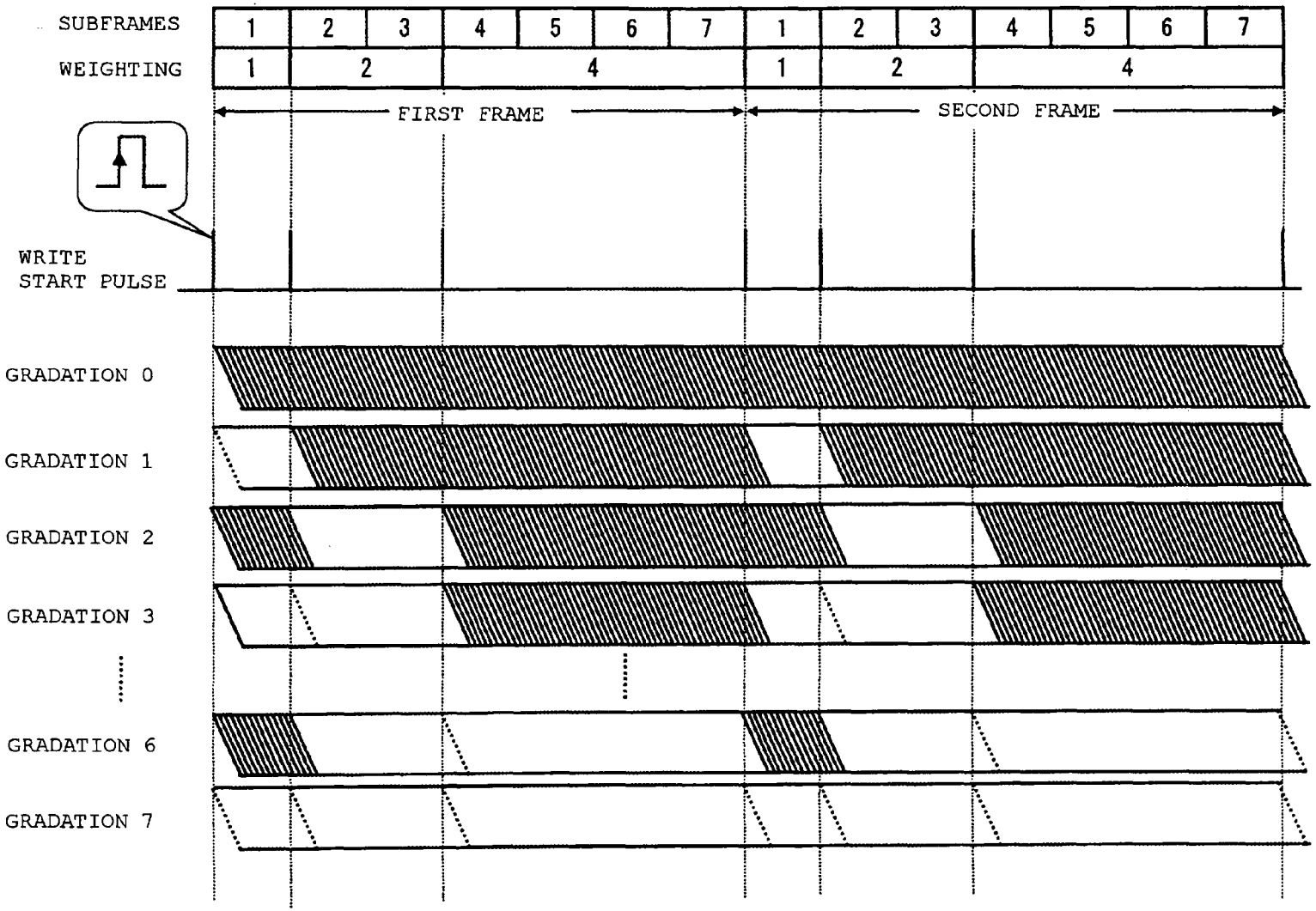
FIG. 4 is a timing chart for describing a weighted subframe method in a time gradation system.
Figure 5:
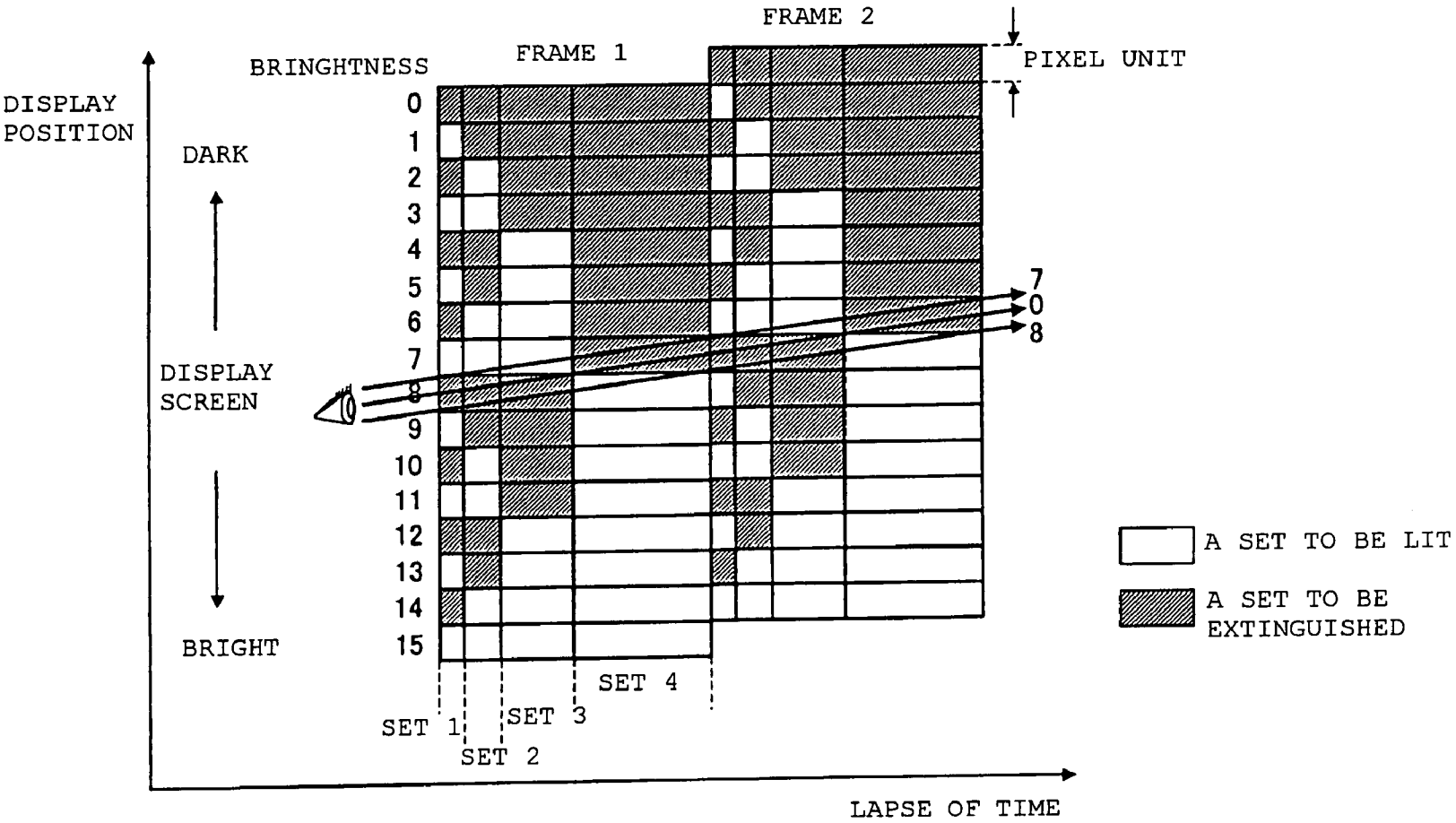
FIG. 5 is a view for describing a mechanism of pseudo-moving-picture outline noise generation.
Figure 6:
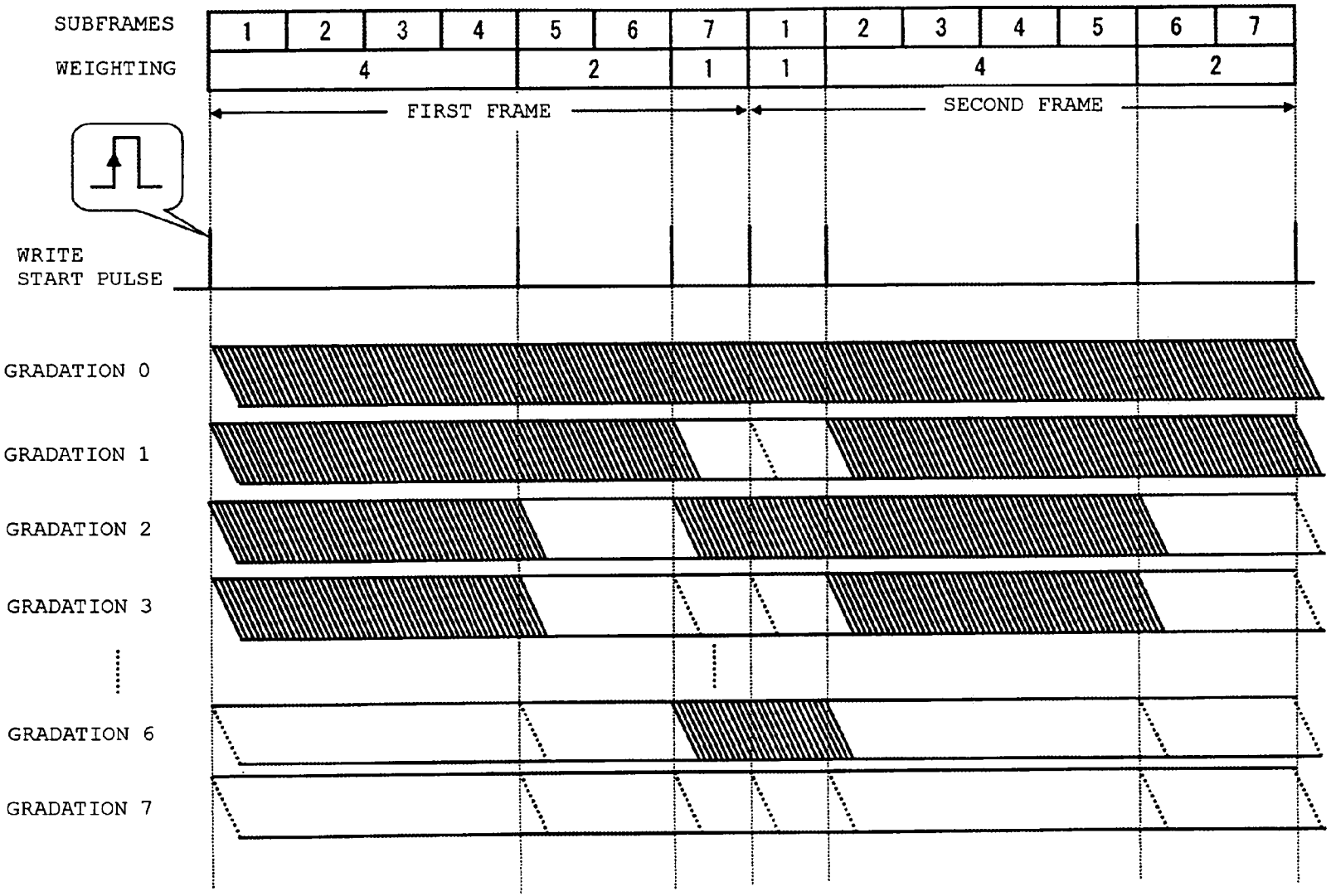
FIG. 6 is a timing chart for describing a lighting driving that reduces the pseudo-moving-picture outline noise in the weighted subframe method.

Also, in the conventional examples shown in FIGS. 1 and 2, an example of a display panel of single color luminescence is shown in which the series circuits of the TFT 12 for driving and the EL element 14 constituting the pixel are all connected between the common anode 16 and the common cathode 17. However, the apparatus for driving a self-luminescent display panel according to the invention described below can be suitably adopted not only in the display panels of single color luminescence but also in the color display panels provided with luminescent pixels (subpixels) of R (red), G (green), and B (blue).

Figure 7:
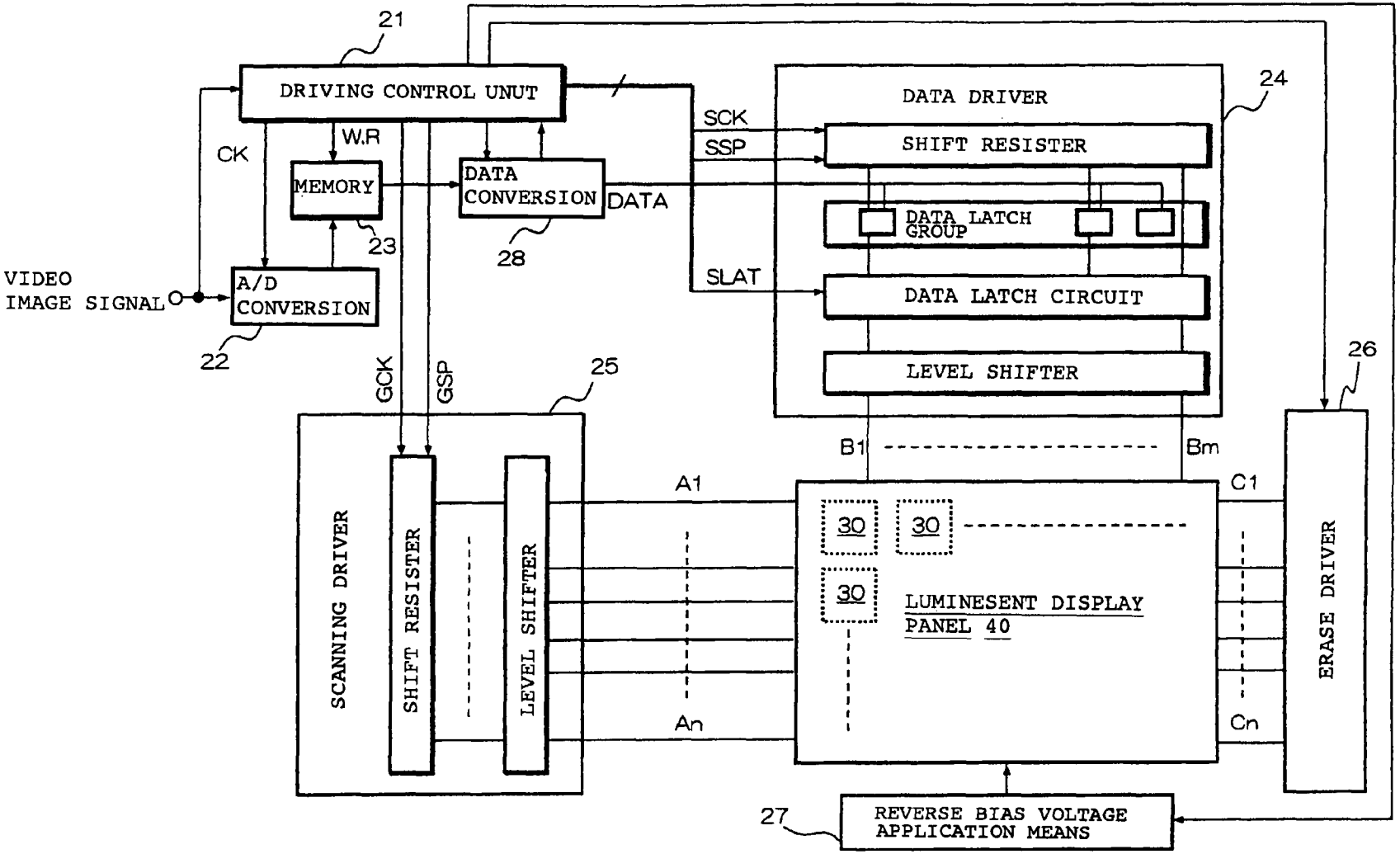
FIG. 7 is a block diagram showing an embodiment according to the driving apparatus of the invention.

FIG. 7 is a block diagram showing the first embodiment in the driving apparatus according to the invention. Referring to FIG. 7, a driving control circuit 21 is adapted to control the operation of a luminescent display panel 40 made of a data driver 24, a scanning driver 25, an erase driver 26, and pixels 30 arranged in a matrix form.

First, an input analog video image signal is supplied to the driving control circuit 21 and an analog/digital (A/D) converter 22. Based on a horizontal synchronization signal and a vertical synchronization signal in the analog video image signal, the driving control circuit 21 creates a clock signal CK to the A/D converter 22 and a writing signal W and a reading signal R to a frame memory 23.

Based on the clock signal CK supplied from the driving control circuit 21, the A/D converter 22 operates to perform sampling of the input analog video image signal, to convert this into pixel data corresponding to each one of the pixels, and to supply the pixel data to the frame memory 23. In accordance with the writing signal W from the driving control circuit 21, the frame memory 23 operates to write the pixel data supplied from the A/D converter 22 sequentially to the frame memory 23.

When writing of the data for one screen (n rows, m columns) in the self-luminescent display panel 40 is finished by such a writing operation, the frame memory 23 operates to supply the data sequentially to data conversion means 28, for example, as pixel data of 6 bits pixel by pixel in accordance with the reading signal R supplied from the driving control circuit 21.

The data conversion means 28 performs a multiple gradation processing described later, and converts such pixel data of 6 bits into the pixel data of 4 bits, and supplies this to the data driver 24 for each one of the rows from the first row to the nth row.

On the other hand, a timing signal is sent from the driving control circuit 21 to the scanning driver 25 and, on the basis of this, the scanning driver 25 sends a gate-on voltage sequentially to each scanning line. Therefore, the driving pixel data for one row that have been read out from the frame memory 23 and have undergone through the data conversion by the data conversion means 28 as described above are subjected to an addressing operation row by row by the scanning of the scanning driver 25.

Also, this embodiment is constructed in such a manner that a control signal is sent from the driving control circuit 21 to the erase driver 26.

Upon receipt of the control signal from the driving control circuit 21, the erase driver 26 applies a predetermined voltage level selectively to electrode lines (which are referred to as control lines C1 to Cn in this embodiment) that are arranged to be electrically separated for each scanning line, as will be described later, so as to control an on-off operation of the TFT 15 for erasure that will be described later.

Further, the driving control circuit 21 sends a control signal to reverse bias voltage application means 27. Upon receipt of the control signal, the reverse bias voltage application means 27 operates to apply a predetermined voltage level selectively to the cathode 32, and to supply a forward or reverse bias voltage to the organic EL element. This reverse bias voltage is a voltage in a direction opposite to the direction (forward direction) in which the electric current flows at the time of luminescence, and is applied to each organic EL element during a period that is not related to the luminescence period for image data display. Here, it is known that, by application of the reverse bias voltage in this manner, the life of luminescence of the elements is elongated against lapse of time.

Figure 8:
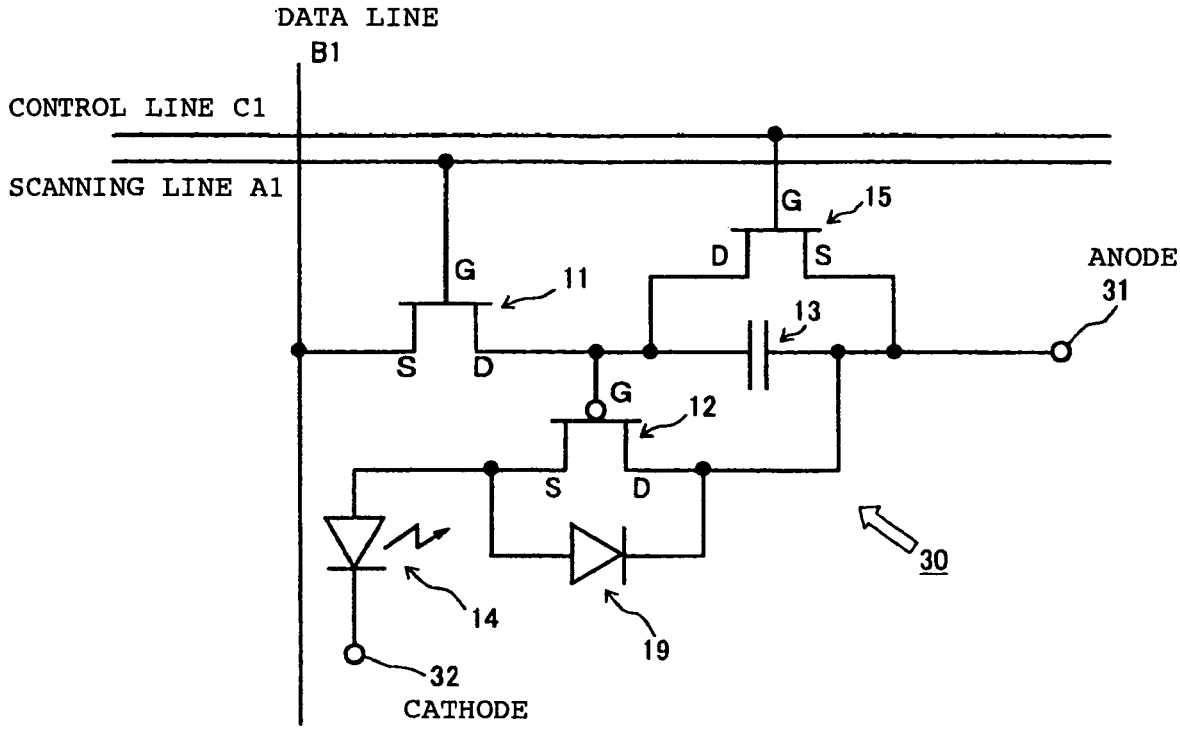
FIG. 8 is a view showing one example of a circuit construction of one pixel among the pixels arranged in a matrix form on the display panel of FIG. 7.

FIG. 8 is a view showing a circuit construction example of one pixel among the pixels 30 that are arranged in a matrix form on the self-luminescent display panel 40. The circuit construction example corresponding to one pixel 30 shown in FIG. 8 is applied to an active matrix type display panel. Then, this circuit is constructed in such a manner that a TFT 15 serving as lighting period control means, which is a transistor for erasure that erases the electric charge stored in the capacitor 13, is added to the circuit construction of the pixel 10 shown in FIG. 1 and that, between the source S and the drain D of the TFT 12 for lighting driving, a diode 19 that is connected to bypass this is added.

First, the TFT 15 for erasure is connected in parallel to the capacitor 13, and can instantaneously discharge the electric charge of the capacitor 13 by performing an on-operation in accordance with the control signal from the driving control circuit 21 during the lighting operation of the organic EL element 14. This can make the pixel extinguished until the next addressing time.

On the other hand, the anode of the diode 19 is connected to the anode of the EL element 14, and the cathode of the diode 19 is connected to the anode 31. Therefore, the diode 19 is connected in parallel between the source S and the drain D of the TFT 12 for driving so as to attain a direction opposite to the forward direction of the EL element 14 having diode characteristics.

Also, in the circuit construction shown in FIG. 8, the cathode of the EL element 14 is connected to the cathode 32 formed in common to the scanning lines A1 to An, and the reverse bias voltage application means 27 shown in FIG. 7 applies a predetermined voltage level selectively to the cathode. In other words, here, assuming that the voltage level applied to the common anode 31 is "Va", a voltage level of, for example, "Vh" or "V1" is selectively applied to the cathode 32. The level difference of "V1" relative to "Va", that is, Va-V1, is set to be in the forward direction (for example, about 10V) in the EL element 14. Therefore, when "V1" is selectively set in the cathode 32, the EL element 14 constituting each pixel 30 will be in a state being capable of emitting light.

Also, the level difference of "Vh" relative to "Va", that is, Va-Vh, is set to be a reverse bias voltage (for example, about −8V) in the EL element 14. Therefore, when "Vh" is selectively applied to the cathode 32, the EL element 14 constituting each pixel 30 will be in a state of not emitting light. At this time, the diode 19 shown in FIG. 8 is brought into a conduction state by the reverse bias voltage.

In the meantime, in the above-described circuit construction, the period of time for supplying a driving current applied to the EL element constituting the luminescent element (lighting period) can be changed, so that the substantial luminescence brightness of the organic EL element 14 can be controlled. Therefore, in the gradation expression in the apparatus for driving a self-luminescent display panel according to the invention, the time gradation system is a basic system. As this time gradation system, the simple subframe method is applied in order to restrain the generation of the aforementioned pseudo-moving-picture outline noise completely and in order to restrain the generation of gradation abnormality. Here, in the present embodiment, the gradation expression in the present circuit construction is realized by the first gradation control means constituted of the driving control circuit 21, the data driver 24, the scanning driver 25, the erase driver 26 (lighting period control means), and the pixels 30, and the second gradation control means constituted of the data conversion means 28.

Also, in the driving apparatus and the driving method according to the present invention, one frame period is time-divided into N subframe periods (N is a positive integer), and a gradation display is performed by an accumulated sum of one or plural lighting control periods. Assuming that a is an integer satisfying $0<a<N$, at least two other subframe periods are lit at a brightness level a in addition to subframe periods lit at a brightness level a−1.

Figure 9:
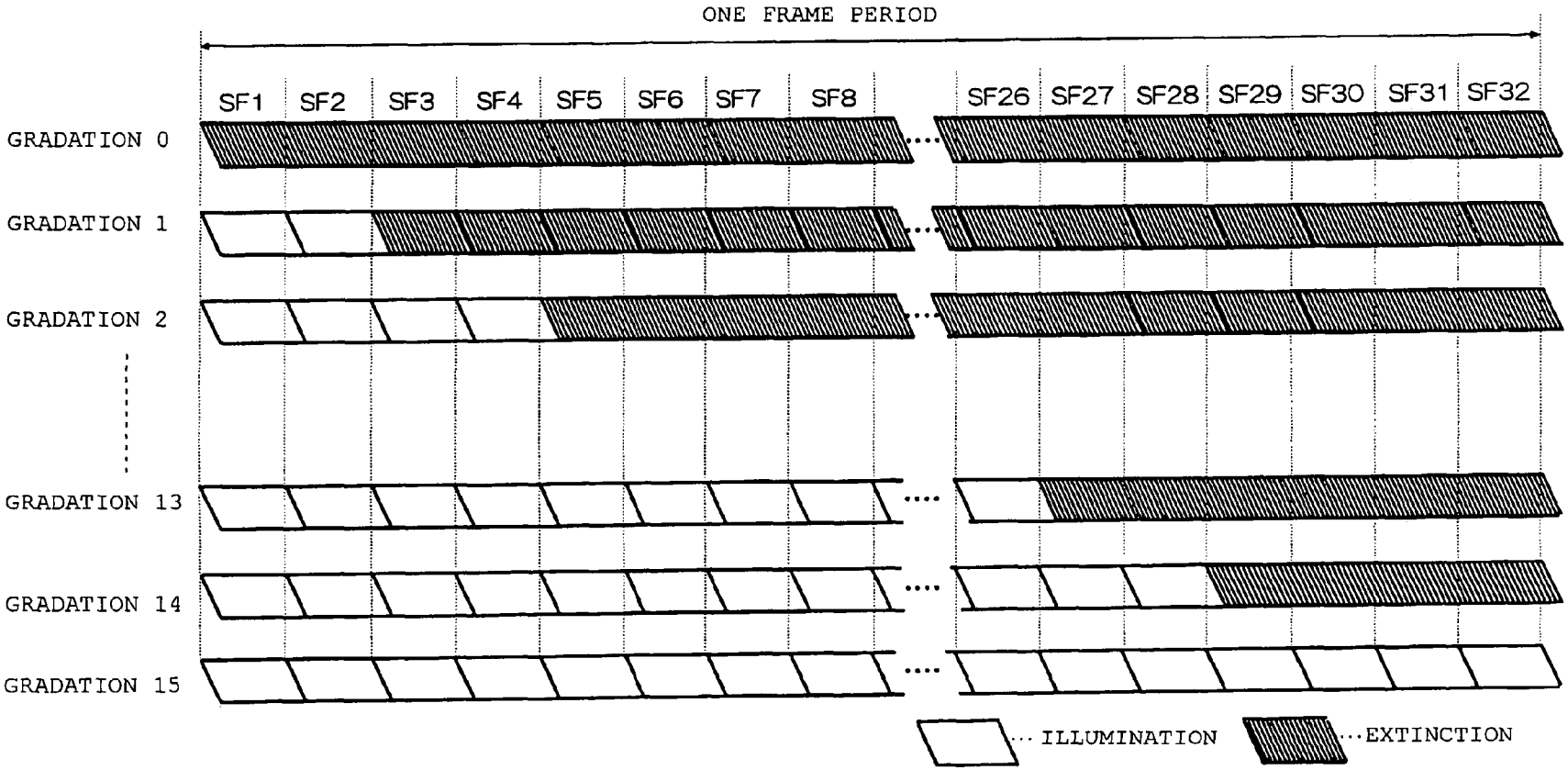
FIG. 9 is a timing chart showing one example of a subframe luminescence period (without gamma correction) of each frame in the driving apparatus of FIG. 7.

For example, in one example shown in FIG. 9, assuming that a display of 16 gradations (gradation 0 to gradation 15) is to be performed by dividing one frame period into 32 (N) subframes (SF1 to SF32), the gradation display is set by an accumulated sum of one or plural lighting control periods. In this case, in displaying the gradation 14 (brightness level a), for example, by the simple subframe method, in addition to the subframe periods lit in the gradation 13 (brightness level a−1), two other subframe periods are lit. Also, in this example, in displaying the gradation 15 (brightness level a), in addition to the subframe periods lit in the gradation 14 (brightness level a−1), four other subframe periods are lit.

Namely, in this example of FIG. 9, from the gradation 1 to the gradation 15 excluding the gradation 0, two or more other subframe periods are lit in addition to the subframe periods lit at the gradation level (brightness level) that is lower by one level. By lighting two or more subframe periods every time the gradation level is raised by one level, the luminescence duty can be largely ensured, and the brightness can be further improved.

Figure 10:
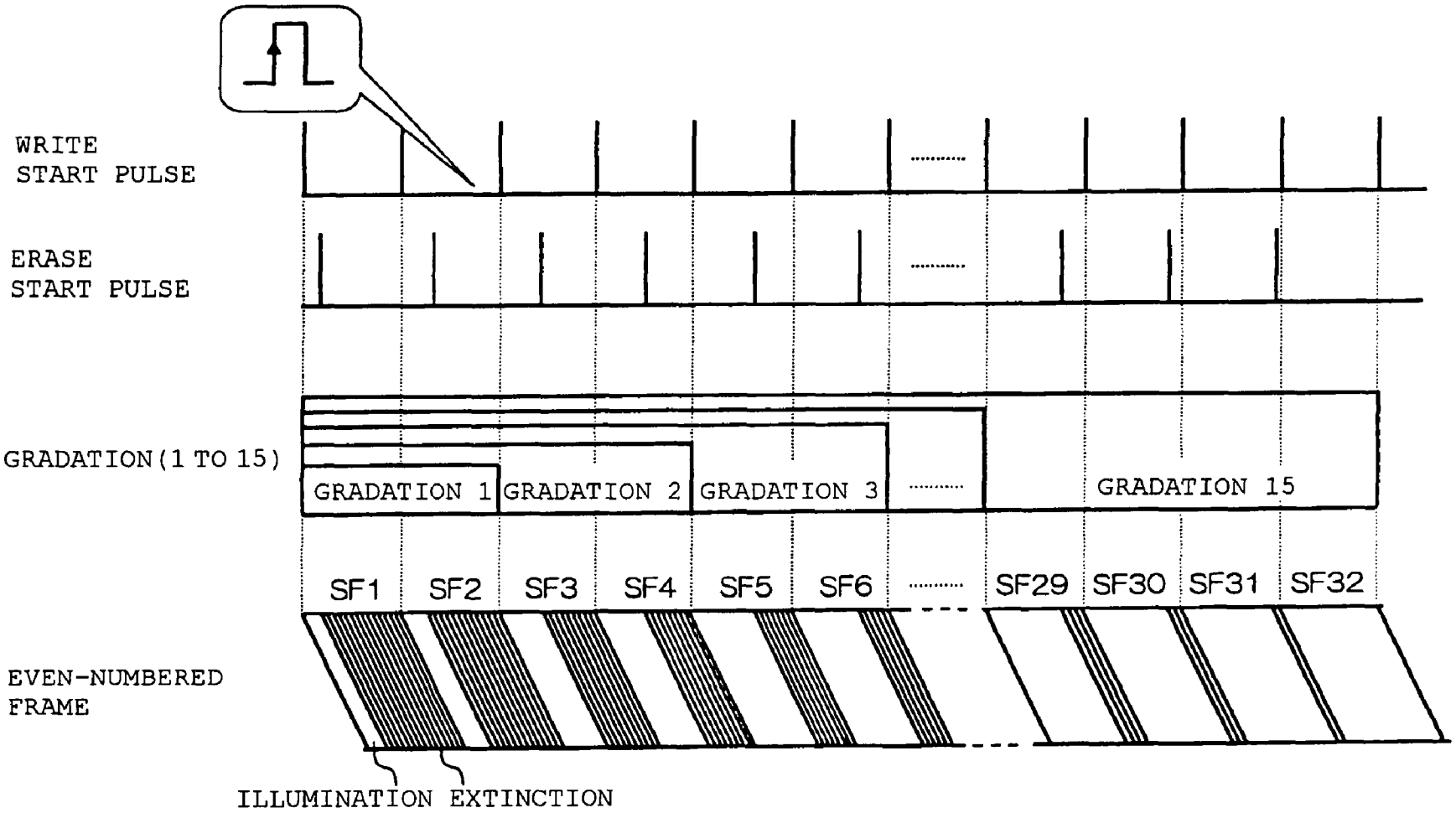
FIG. 10 is a timing chart showing one example of a subframe luminescence period (with gamma correction) of each frame in the driving apparatus of FIG. 7.
Figure 11:
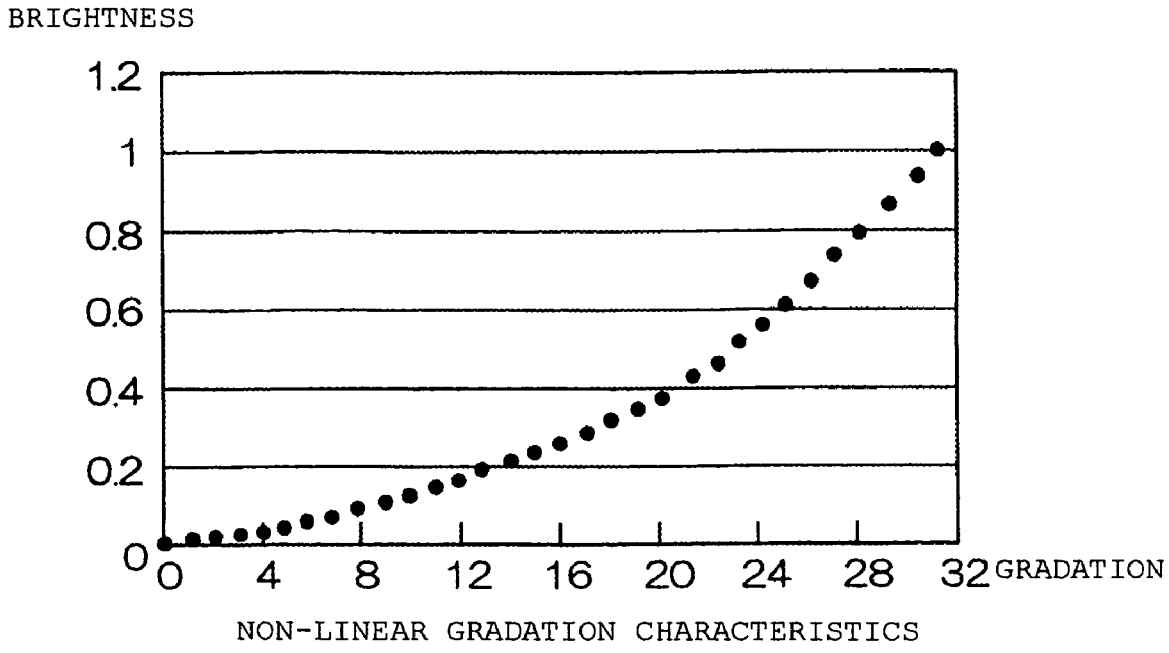
FIG. 11 is a graph showing non-linear gradation characteristics.

Also, in the example shown in FIG. 9, the lit subframes are lit at all times during the period of the subframe. However, if one wishes to perform a more natural gradation expression, the ratios of the lighting periods in the subframe periods are made all different, as shown in FIG. 10, for example. Then, the length of the lighting period in each subframe period is set so that the brightness curve among the gradations displayed by the simple subframe method will be non-linear (for example, gamma value 2.2) as shown in FIG. 11. Therefore, the gradation display by the simple subframe method can be made to have non-linear characteristics (hereafter referred to as gamma characteristics), thereby realizing a more natural gradation display.

Here, in FIG. 10, in the display of gradation 1 to gradation 15, two or more other subframe periods are lit in addition to the subframe periods lit at the gradation level (brightness level) that is lower by one level, in the same manner as in FIG. 9. Also, the creation of the lighting period in each subframe period is carried out by driving the TFT 15 for erasure to discharge the electric charge of the capacitor 13 instantaneously in accordance with the erase start pulse from the erase driver 26.

Figure 12:
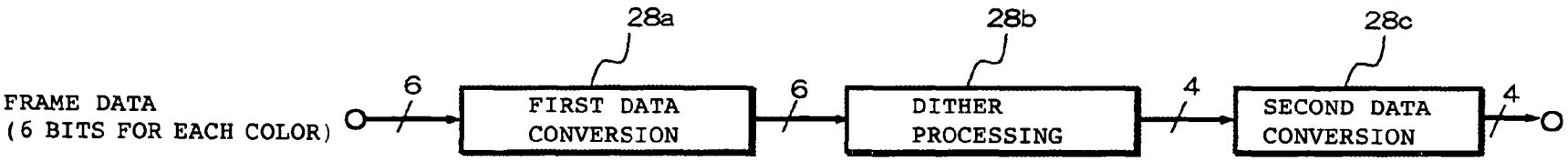
FIG. 12 is a block diagram for describing an internal process of the data conversion means of FIG. 7.

Also, in the driving apparatus and the driving method according to the invention, in order to realize multiple gradation display by the simple subframe method, a data conversion process using a dither process as an axis is carried out. FIG. 12 is a block diagram for describing the data conversion means 28 that performs the data conversion process for the multiple gradation display. As shown in FIG. 12, data of 6 bits for one pixel are successively input from the frame memory 23 into the data conversion means 28. The input pixel data are subjected to the data conversion process in the first data conversion means 28*a*.

As a pre-stage process of the dither process carried out at a later stage, the data conversion process in the first data conversion means 28*a* is carried out as a countermeasure against overflow in the dither process, as a countermeasure against noises caused by the dither pattern, and the like. Specifically, for example, on the pixel data, among the values of 0 to 63 serving as the input 6-bit data, the data conversion means 28*a* outputs the values 0 to 58 as they are, outputs the value 57 by converting it into the value 58 by adding one, and outputs the values 58 to 63 by converting them forcibly to the value 60 for prevention of overflow.

Here, such conversion characteristics are set in accordance with the number of bits in the input data, the number of displayed gradations, and the number of compressed bits by performing multiple gradation.

The pixel data of 6 bits subjected to the conversion process in the first data conversion means 28*a* then receive addition of dither coefficients respectively in the dither process means 28*b*, thereby to perform a multiple gradation process. In this dither process means 28*b*, after the dither coefficients are added to the brightness data of the pixel, the lower two bits among the pixel data of 6 bits are discarded. Namely, a real gradation is expressed by the upper four bits, and a pseudo gradation display corresponding to two bits is realized by the dither process.

Figure 13A:
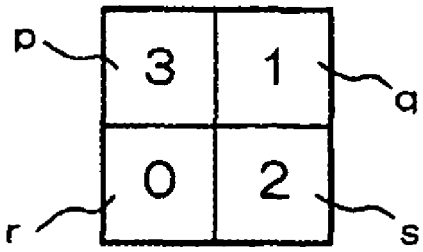
FIG. 13 is a view showing one example of an arrangement of dither coefficients corresponding to two consecutive subframes and an example of lighting patterns of the subframes corresponding thereto in the first embodiment according to the invention.
Figure 13A:
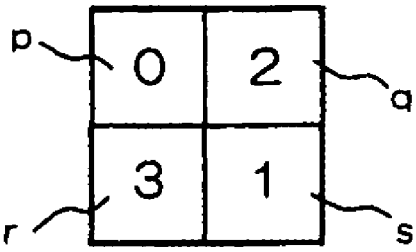
Figure 13B:
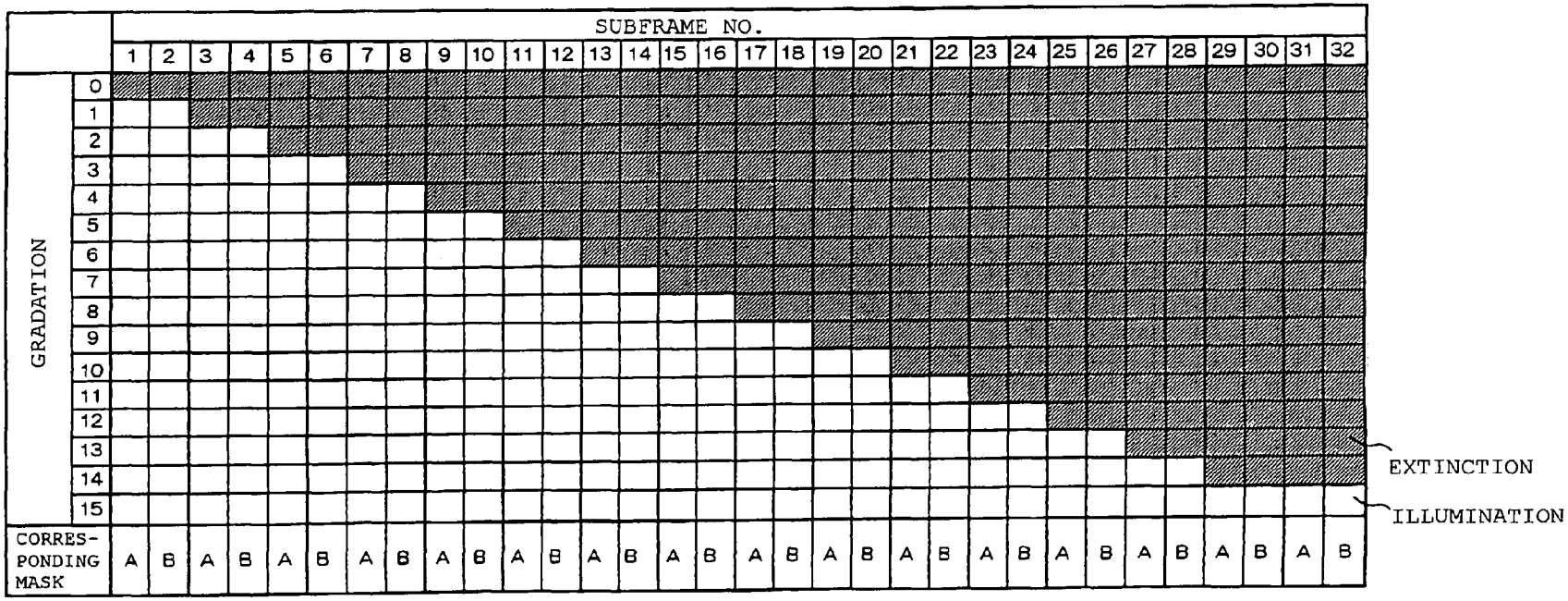

To describe this in more detail, referring to FIG. 13A, by treating four pixels p, q, r, s that are adjacent to each other in an up-and-down direction and in a right-and-left direction as one set, dither coefficients 0 to 3 that are different from each other are respectively allotted and added to the pixel data corresponding to the pixels in this one set. In FIG. 13A, the numbers (0, 1, 2, 3) shown in the pixels show an arrangement of the dither coefficients (values) that are respectively added to the pixel data. In the example shown in FIGS. 9 and 10, since two subframes are newly lit when the gradation (brightness level) changes from a−1 to a, two kinds of arrangement patterns of dither coefficients (dither masks A, B) are set in accordance with the number of newly lit subframes. As shown in FIG. 13B, the dither coefficients that are added in the same pixel for each subframe are made different from each other.

At that time, the arrangement of the dither coefficients is made so that the sum (accumulated sum) of the dither coefficients of the dither mask A and the dither mask B in the same pixel will all be equal in the four pixels p, q, r, s. Such an arrangement of the dither coefficients is made in order to reduce the noise caused by the dither pattern. In other words, when a dither pattern made of dither coefficients 0 to 3 is added constantly to each pixel, the noise caused by this dither pattern may possibly be visually recognized, thereby deteriorating the image quality. Therefore, by changing the dither coefficients subframe by subframe as described above, the noise caused by the dither pattern can be reduced. Here, in the example of FIG. 13, the sum of the dither coefficients of the dither mask A and the dither mask B in the same pixel is a value of 3.

Figure 14C:
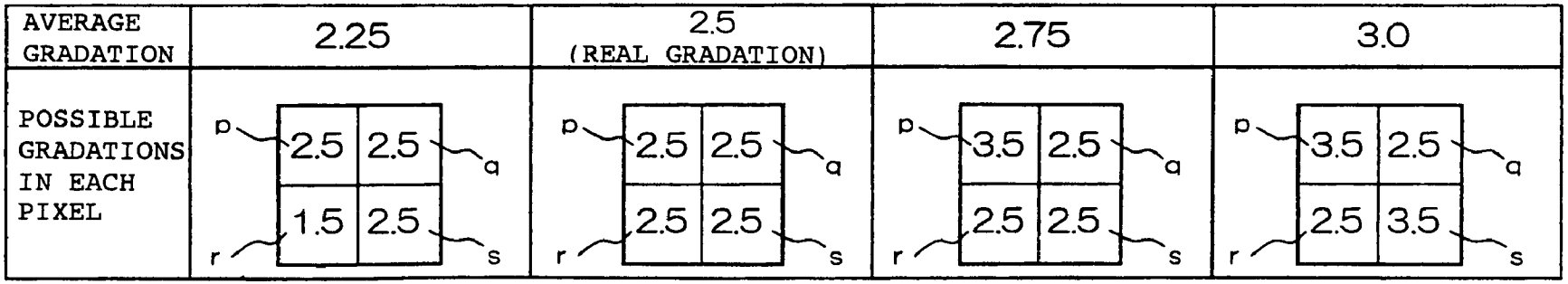

This dither process generates a combination of four intermediate display levels with the four pixels. Therefore, even if the number of bits in the pixel data is four, for example, the number of displayable brightness gradation levels will be larger by four times, namely, half tone display corresponding to 6 bits (64 gradations) can be made. For example, as shown in FIG. 13B, in a display of real gradation 2, the dither process is carried out with the dither mask A of FIG. 13A at the time of lighting of the third subframe. As a result of this, the displayable gradations and the average gradation in the four pixels are as shown in FIG. 14A, so that gradation display of four stages can be made. In a display of real gradation 3, the dither process is carried out with the dither mask B of FIG. 13A at the time of lighting of the sixth subframe. As a result of this, the displayable gradations and the average gradation in the four pixels are as shown in FIG. 14B.

By performing a dither process alternately for each subframe with use of different dither masks for four pixels treated as one set, the gradation in the same pixel will be different between consecutive subframes. For example, in a display of real gradation 3, the dither process is carried out with the dither mask A of FIG. 13A at the time of lighting of the fifth subframe, and the displayable gradations and the average gradation in the four pixels areas shown in FIG. 14C. Namely, since the dither masks subjected to the dither processing are different between FIG. 14B and FIG. 14C, the gradation of the same pixel at the same average gradation will have a different value. For this reason, in the consecutive subframe periods, the accumulated gradations in the same pixel treated with different dither masks will be averaged among the four pixels. As a result of this, the noise (harshness) specific to the dither pattern is further reduced.

Here, in the display of gradation 1 to gradation 14 shown in FIGS. 9 and 10, two other subframe periods are lit in addition to the subframe periods lit at the gradation level (brightness level) that is lower by one level, as described above. However, the invention is not limited to this alone, so that the driving apparatus may have a construction such that two or more other subframe periods are lit in addition to the subframe periods lit at the gradation level that is lower by one level.

For example, referring to FIG. 15, from gradation 1 to gradation 14, four other subframe periods may be lit in addition to the subframe periods lit at the gradation level that is lower by one level. In this case, in order to maintain the number of gradations, the number of subframes constituting one frame period is formed, for example, with 64 subframe periods, which is a double of that in the example of FIGS. 9 and 10. In the gradation 15, eight other subframe periods are lit in addition to the subframe periods lit in the gradation 14. By doing so, the luminescence duty can be more largely ensured, thereby further improving the brightness.

Figure 15A:
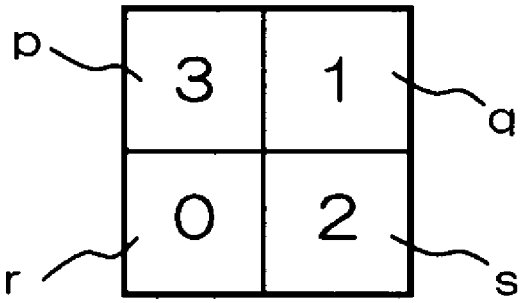
FIG. 15 is a view showing one example of an arrangement of dither coefficients corresponding to four consecutive subframes and an example of lighting patterns of the subframes corresponding thereto in the first embodiment according to the invention.
Figure 15A:
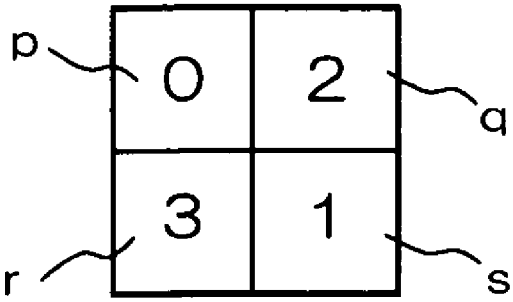
Figure 15A:
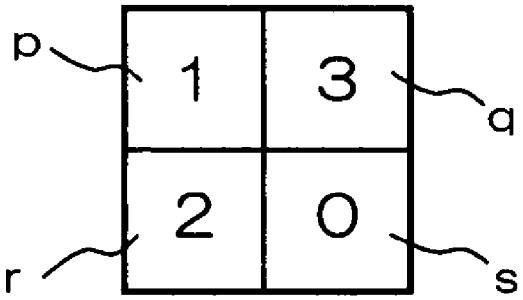
Figure 15A:
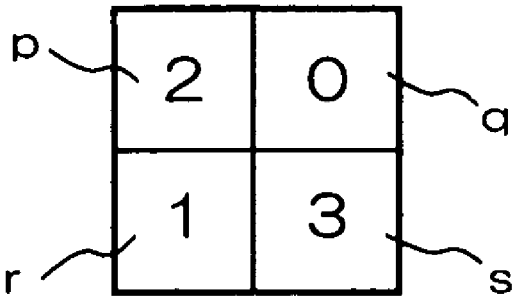

For the dither process in this case, four kinds of dither patterns (dither masks A, B, C, D) are set as shown in FIG. 15A in accordance with the number of subframes that are newly lit by increment of one gradation. Namely, this is to disperse the dither pattern in the newly lit plural subframe periods so as to reduce the noise caused by the dither pattern when the gradation changes from a to a−1.

Figure 15B:
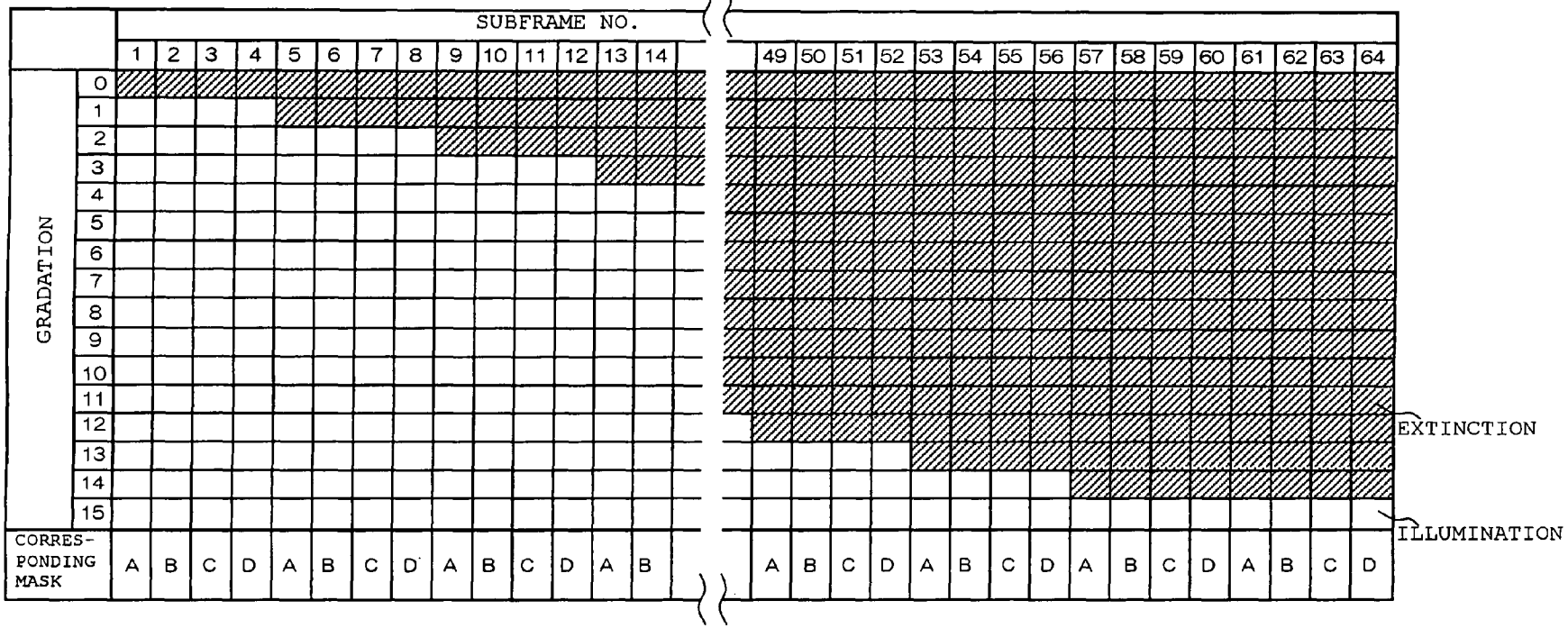

Referring to FIG. 15B, the dither coefficients that are added in the same pixel for each subframe are made different from each other. At that time, an arrangement of the dither coefficients is made so that the sum of the dither coefficients of the dither masks A to D in the same pixel will all be equal in the four pixels p, q, r, s. Here, in the example of FIG. 15, the sum of the dither coefficients of the dither masks A to D in the same pixel is a value of 6.

Figure 16:
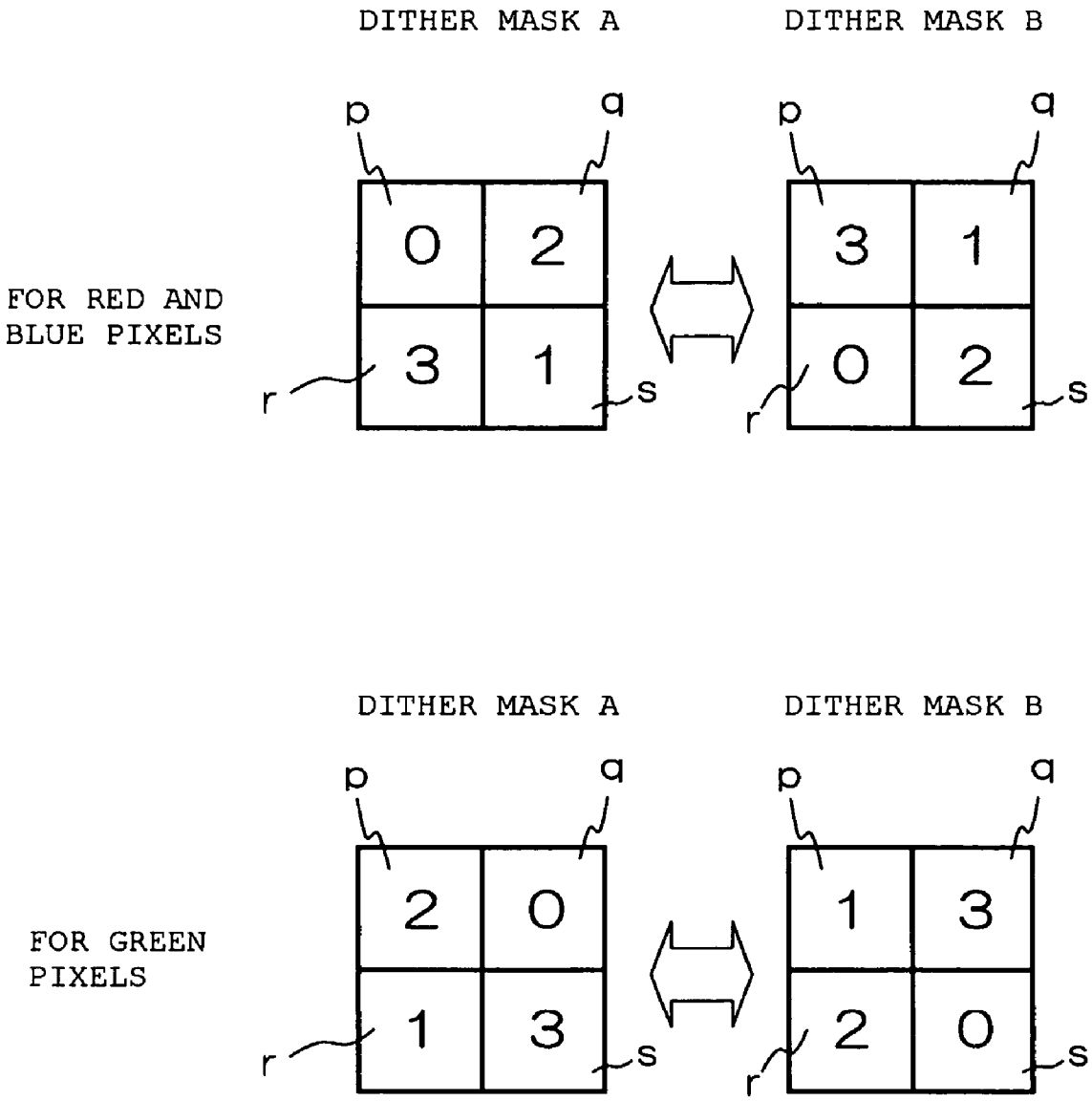
FIG. 16 is a view showing one example of an arrangement pattern of dither coefficients in pixels of different colors.

Also, in the case where the luminescent display panel 40 is a color display panel, the dither coefficients to be added may be made different for each luminescence pixel of R (red), G (Green), B (blue). For example, even with the same brightness data for luminescence, actual luminescence brightness in the pixels of red and blue is lower than actual luminescence brightness in the pixels of green. Therefore, as shown in FIG. 16, for example, by using the same combination of the dither coefficients for the pixels of red and blue and using dither coefficients different from those of the red and blue pixels for the pixels of green, the noise caused by the dither pattern can be further reduced.

Also, in the data conversion means 28 shown in FIG. 12, the pixel data of four bits subjected to the multiple gradation process by the dither processing means 28*b* are output to the second data conversion means 28*c*. In the second data conversion means 28*c*, the pixel data of four bits assuming a value of any of 0 to 15 are converted into pixel data HD for display made of the 1st bit to the 15th bit corresponding to the subframes SF 1 to 32 (in the case of the timing chart of FIGS. 9 and 10) in accordance with the conversion table 29 shown in FIG. 17. Here, in FIG. 17, the bit of the logic level "1" in the pixel data HD for display shows implementation of pixel luminescence in the subframe SF corresponding to the bit. For example, when HD 1, 2 assume a logic 1, the pixel luminescence in the subframes SF 1 to 4 is executed.

The pixel data HD subjected to such conversion are supplied to the data driver 24. At this time, the mode of the pixel data HD for display assumes one pattern among the 16 patterns shown in FIG. 17. The data driver 24 allots each of the 1st bit to 15th bit in the pixel data HD for display to the subframes SF 1 to 32. Therefore, when the bit logic thereof is 1, the corresponding pixel is addressed by the scanning of the scanning driver 25, and a luminescence operation is carried out during the subframe period.

As described above, the first embodiment of the invention adopts the simple subframe method instead of the weighted subframe method for gradation expression, so that the generation of pseudo-moving-picture outline noise and the gradation abnormality can be completely restrained. Also, for the multiple gradation display which raised a problem in the case of using the simple subframe method, the problem can be solved by using the dither method. Also, in a display of real gradation data by the time gradation system, the luminescence duty can be largely ensured and the brightness can be further improved by lighting two or more other subframe periods in addition to the subframe periods lit at the gradation level (brightness level) that is lower by one level. Such control is effective in the case of allowing the ratio of the lighting time in each subframe period to have non-linear characteristics (gamma characteristics). Moreover, by devising the arrangement of the dither coefficients or the like, the noise of the dither pattern caused by using the dither method can be reduced, thereby improving the sense of S/N.

Here, in the above-described first embodiment, in the display of any gradation, it is preferable to provide a subframe period of absolute non-lighting period at the last of the frame period, and to apply a reverse bias voltage to the organic EL element 14 by the reverse bias voltage application means 27 during that period. This produces an effect such as elongation of the life of the element.

Next, the second embodiment of a driving apparatus according to the invention will be described. Here, in the second embodiment, the same construction as the total construction of the driving apparatus shown in FIG. 7 in the first embodiment will be adopted. Therefore, in the following description, the part corresponding to each section shown in FIGS. 1 and 7 already described above is denoted with the same symbol, and therefore description of individual functions and operations will be omitted at appropriate times.

Figure 18A:
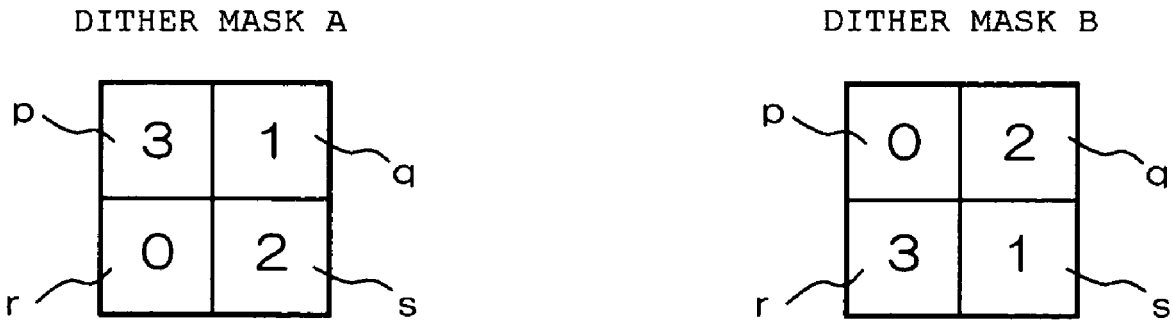
FIG. 18 is a view showing one example of an arrangement of dither coefficients corresponding to two consecutive subframes and an example of lighting patterns of the subframes in the odd-numbered frames and the even-numbered frames corresponding thereto in the second embodiment according to the invention.
Figure 18B:
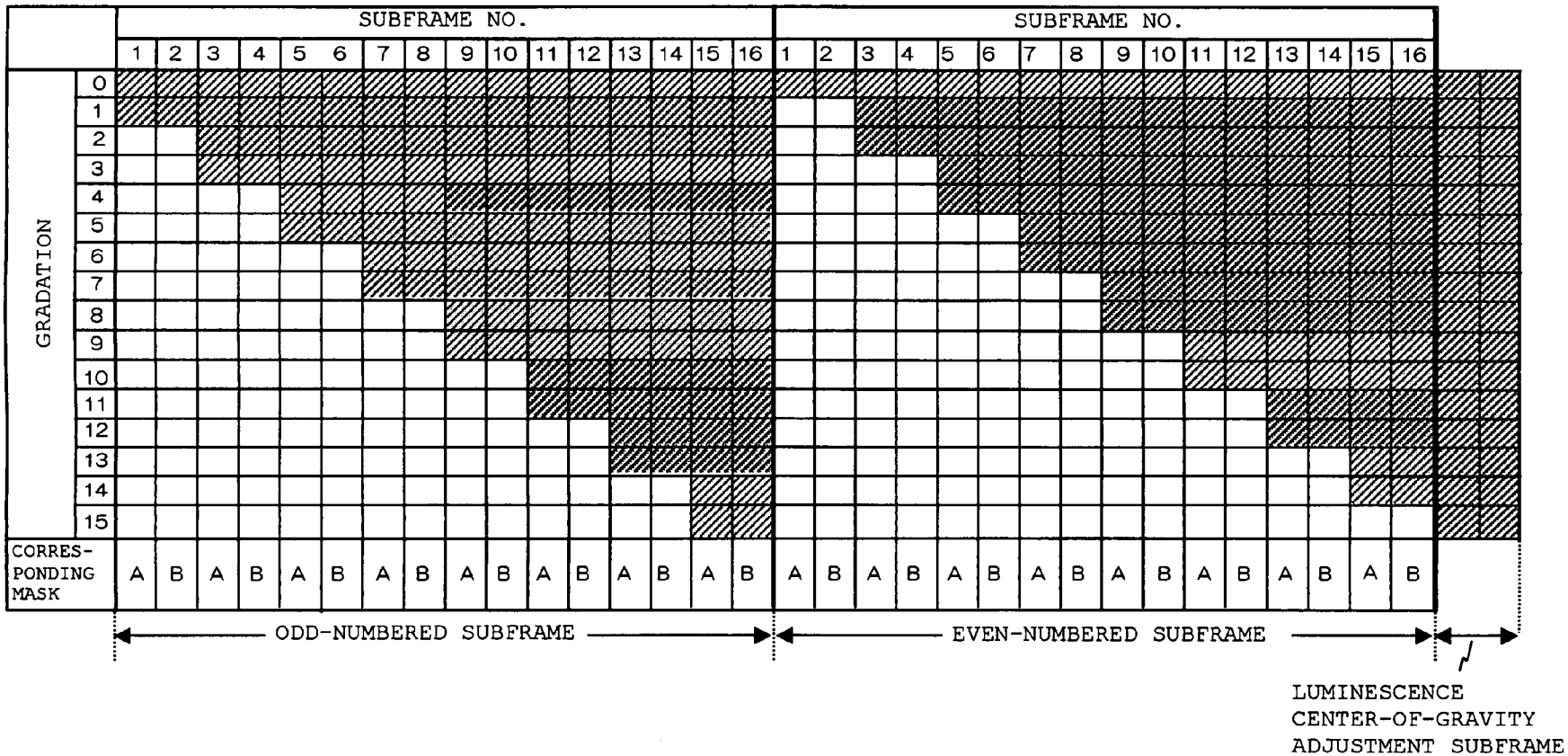

FIG. 18 is a view showing a subframe lighting pattern (FIG. 18B) of gradation display by the driving apparatus according to the second embodiment and an example of a dither mask corresponding thereto (FIG. 18A) (16 gradation display with 16 subframes). As shown in FIG. 18B, in this embodiment, lighting control units for each gradation are respectively separately set in the odd-numbered and even-numbered frames. For example, in the odd-numbered frames, four subframe periods are lit in the display of gradation 5, while in the even-numbered frames, six subframe periods are lit.

Namely, assuming that a is an integer satisfying $0<a<N$, control is made so that the number of lit subframes will be different between the odd-numbered frames and the even-numbered frames when the gradation (brightness level) is $a-1$ or a. Such control is realized by using different conversion tables for the odd-numbered frames and the even-numbered frames in the second data conversion means 28*c* (third gradation control means).

For example, in the odd-numbered frames, a conversion table 33 shown in FIG. 19 is used, while in the even-numbered frames, a conversion table 35 shown in FIG. 20 is used. Then, the pixel data HD for display of the odd-numbered frames and the pixel data HD for display of the even-numbered frames are alternately output to the data driver 24. The data driver 24 processes the pixel data HD for display of the odd-numbered frames and the pixel data HD for display of the even-numbered frames alternately for each frame by the control of the driving control circuit 21, and allots each of the 1st bit to 15th bit to the subframes SF1 to SF16 in accordance with the conversion tables 33, 35. When the bit logic thereof is 1, the corresponding pixel is addressed by the scanning of the scanning driver 25, and a luminescence operation is carried out during the subframe period.

Also, in this case, since the luminescence periods to be carried out may be different from each other between the odd-numbered frames and the even-numbered frames depending on the gradation, two kinds of luminescence driving of 16 gradations (real gradation) are alternately carried out for each frame. By such driving, the number of displayed gradations in the visual sense increases to be more than 16 gradations when integrated in the time direction. Therefore, the noise of the dither pattern caused by the multiple gradation process (dither process) will be less conspicuous, thereby improving the sense of S/N.

However, when two kinds of luminescence driving having luminescence periods different from each other are carried out in the even-numbered frames and the odd-numbered frames in this manner, the luminescence center-of-gravity within one frame period will be shifted from each other, thereby possibly generating a flicker. Therefore, in the driving apparatus according to the invention, in order to make the luminescence center-of-gravity of each frame to be the same, a luminescence center-of-gravity adjustment subframe which is a dummy subframe is provided in one frame (at the last of the even-numbered frames in FIG. 18), and this period is made to be a non-lit period.

Further, during the non-lit period in this luminescence center-of-gravity adjustment subframe, the reverse bias voltage application means 27 applies a reverse bias voltage to all of the organic EL elements. Namely, the reverse bias voltage can be applied without specially providing a period for application of the reverse bias voltage that is needed in the driving of the luminescence display panel using organic EL elements.

As described above, according to the second embodiment of the invention, in the same manner as the effects produced by the first embodiment, restraint of the pseudo-moving-picture outline noise and the gradation abnormality caused by using the simple subframe method and improvement in the number of displayable gradations by using the dither method can be obtained. In addition, by devising an arrangement of the dither coefficients and performing a control so that the lighting period will be different between consecutive frames, the noise of the dither pattern is further reduced, thereby improving a sense of S/N.

Here, in the above-described first and second embodiments, examples have been shown in which the dither process is carried out by treating four pixels as one set; however, it is not limited to this alone, so that the dither process may be carried out, for example, by treating adjacent nine pixels as one set as shown in FIG. 21A, or by treating adjacent sixteen pixels as one set as shown in FIG. 21B. Here, in FIG. 21, each square partitioned by lines represents a pixel, and the number represents a dither coefficient.

Also, in the construction example shown in FIG. 7, the video image signal (pixel data) output from the A/D converter 22 is temporarily stored in the frame memory 23 screen by screen, and thereafter subjected to processing in the data conversion means 28. Such a construction is effective in an apparatus for driving a display panel of a portable telephone or the like in which the video image data do not necessarily change for each frame. However, in the case where a video signal is input into the A/D converter 22, a video image signal is input for each frame, so that it is possible to adopt a construction in which the video image signal (pixel data)

output from the A/D converter 22 is successively subjected to data conversion in the data conversion means 28, and the converted data may be temporarily stored in the frame memory 23 screen by screen.

Also, as shown in FIG. 7, a construction has been made in which the reverse bias voltage application means 27 is provided, so as to apply a reverse bias voltage to the organic EL element 14. However, it is not limited to this construction alone, so that an equi-potential application means may be provided in place of the reverse bias voltage application means 27, so as to perform a process (which is referred to as equi-potential reset) of setting both poles of the organic EL element 14 to have an equal potential. By this equi-potential reset, discharge or the like of the element is carried out during the process, thereby obtaining an effect of elongation of the life of the element, in the same manner as the effect produced by reverse bias voltage application.

Figure 22:
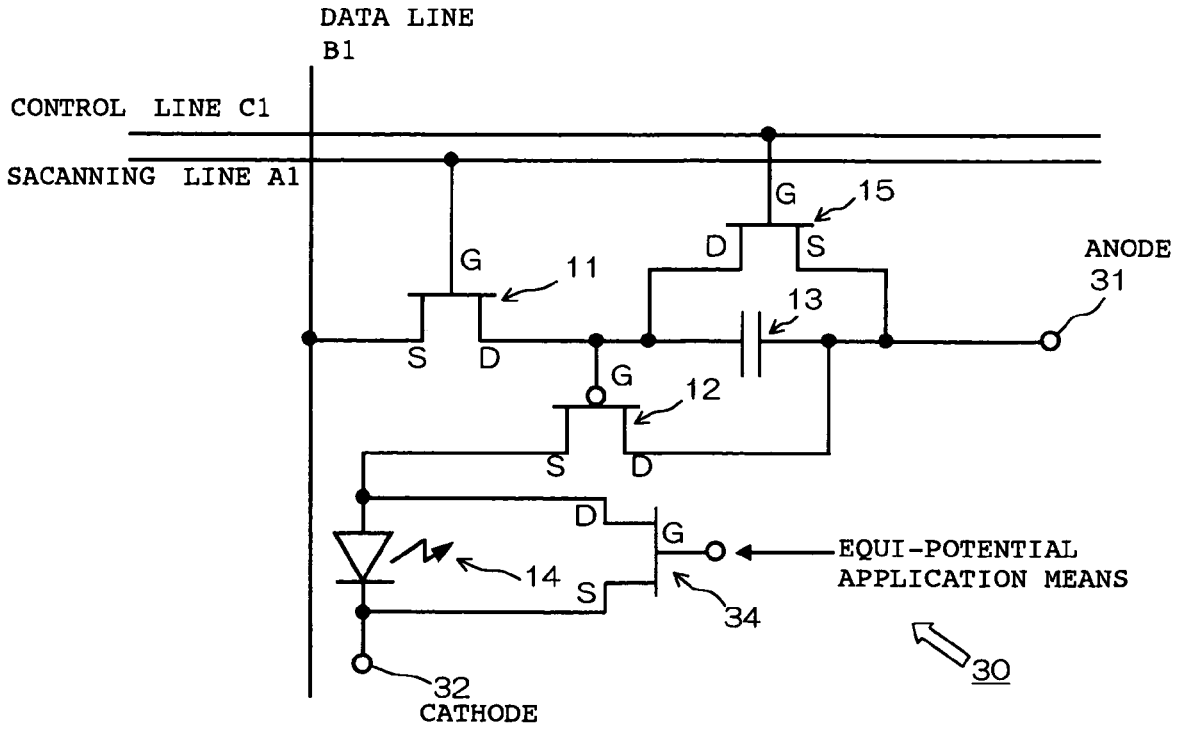
FIG. 22 is a view showing another example of a circuit construction of one pixel among the pixels arranged in a matrix form on the display panel of FIG. 7.

In that case, the equi-potential application means performs the equi-potential reset on all the pixels, for example, by bringing the TFT 12 for driving to an on-state to make the anode 31 and the cathode 32 have the same electric potential (for example, connected to the ground) in the circuit construction of all the pixels. Alternatively, as shown in FIG. 22, a TFT 34 for equi-potential reset may be provided between the two poles of the organic EL element 14 of each pixel, and a process of bringing the TFT 34 to an on-state to make the two poles of the element have the same electric potential may be carried out by the equi-potential application means. In this case, the equi-potential reset can be performed pixel by pixel.

Also, in the above-described embodiments, the pixel data are assumed to have 6 bits, and the number of gradation expressions is assumed to be 64 for the sake of convenience. however, the invention is not limited to this alone, so that the driving apparatus and the driving method according to the invention can be applied to a more multiple gradation display or to a lower gradation.

What is claimed is:

1. A self-luminescent display panel provided with a plurality of luminescent elements that are arranged at intersection positions of a plurality of data lines and a plurality of scanning lines, comprising:

one frame period, which is time-divided into an even numbered minor frame and an odd numbered minor frame, said even numbered minor frame and said odd numbered minor frame containing N subframe periods wherein N is a positive integer, and a gradation display by a simple subframe method is set by an accumulated sum of one or plural lighting control periods, said panel being provided with a first gradation controller for lighting subframe periods for performing, with a plurality of pixels adjacent to each other being treated as one set, a dither processing for each subframe set by set, wherein when the gradation changes from (a−1) to (a), a plurality of kinds of arrangement patterns of dither coefficients are set in accordance with the number of newly lit subframes whereby the dither coefficients added in the same pixel for each subframe are made different from each other, and, in a plurality of pixels constituting a set on which said dither processing is performed, accumulated sums of the dither coefficient values added to a same pixel for each subframe are equal to each other among said plurality of pixels in a plurality of subframe units that are newly lit when the brightness level changes from (a−1) to (a), wherein an additional two subframe periods are lit in each of the even and odd numbered minor frames when the gradation level increases from (a−2) to (a), wherein the number of lit subframe periods in said even number minor frame is the same, between two consecutive gradations, wherein the number of lit subframe periods in said odd number minor frame is the same, between two consecutive gradations, wherein the number of lit subframe periods for a given gradation level is shifted by one with respect to the even and odd numbered minor frames, and wherein alternate dither masks are used with respect to sequentially lit subframe periods in both the even and odd minor frames.

2. The self-luminescent display panel according to claim 1, wherein said first gradation controller includes a lighting period controller for extinguishing a currently luminescent subframe at an arbitrary time, and said lighting period controller allows a ratio of a lighting period in each subframe period to have non-linear characteristics.

3. The self-luminescent display panel according to claim 2, wherein said non-linear characteristics are gamma characteristics.

4. The self-luminescent display panel according to claim 1, wherein said self-luminescent display panel is provided with luminescent elements of plural colors, and an arrangement of the dither coefficient values in the pixels of at least one color is different from an arrangement of the dither coefficient values for the pixels of other colors.

5. The self-luminescent display panel according to claim 1, further provided with a third gradation controller comprising a conversion table recorded correspondence relation between pixel data for display and the subframes and controlling the number of lit subframes by using different conversion tables for the odd-numbered minor frames and the even-numbered minor frames, wherein a luminescence center-of-gravity subframe period is provided at either the odd-numbered frames or the even-numbered frames for adjustment of a shift of a luminescence center-of-gravity between the odd-numbered minor frame and the even-numbered minor frame which is generated by the control of said third gradation controller.

6. The self-luminescent display panel according to claim 5, further provided with a reverse bias voltage unit for applying a reverse bias voltage to said luminescent elements, wherein said reverse bias voltage unit applies a reverse bias voltage to at least a part of the luminescent elements in the luminescence center-of-gravity subframe period.

7. The self-luminescent display panel according to claim 5, further provided with an equi-potential unit for performing an equi-potential reset of a luminescent element by setting both poles of said luminescent element to have an equal potential, wherein said equi-potential unit performs the equi-potential reset of at least a part of the luminescent elements in the luminescence center-of-gravity subframe period.

8. A method for driving a self-luminescent display panel provided with a plurality of luminescent elements that are arranged at intersection positions of a plurality of data lines and a plurality of scanning lines, comprising:

time-dividing one frame period into an even numbered minor frame and an odd numbered minor frame, said even numbered minor frame and said odd numbered minor frame containing N subframe periods wherein N is a positive integer, and a gradation display by a simple subframe method is set by an accumulated sum of one or a plurality of lighting control periods, performing dither processing for each subframe set with a plurality of pixels adjacent to each other being treated as one set, setting a plurality of kinds of arrangement patterns of dither coefficients when the gradation changes from (a−1) to (a), in accordance with the number of newly lit subframes whereby the dither coefficients added in the same pixel for each subframe are made different from each other and, in a plurality of pixels constituting a set on which said dither processing is performed, accumulated sums of the dither coefficient values added to a same pixel for each subframe are equal to each other among said plurality of pixels in a plurality of subframe units that are newly lit when the brightness level changes from (a−1) to (a), lighting an additional two subframe periods in each of the even and odd numbered frames when the gradation level increases from (a−2) to (a), the number of lit subframes in said even number minor frame is the same, between two consecutive gradations, the number of lit subframes in said odd number minor frame is the same, between two consecutive gradations, wherein the number of lit subframe periods for a given gradation level is shifted by one, with respect to the even and odd numbered minor frames, and using alternating dither masks with respect to a sequentially lit subframe in both the even and odd frames.

9. The method for driving a self-luminescent display panel according to claim 8, wherein a currently luminescent subframe is extinguished at an arbitrary time, and a ratio of a lighting periods in each subframe period is allowed to have non-linear characteristics.

10. The method for driving a self-luminescent display panel according to claim 9, wherein said non-linear characteristics are gamma characteristics.

11. The method for driving a self-luminescent display panel according to claim 10, wherein said self-luminescent display panel is provided with luminescent elements of plural colors, and an arrangement of the dither coefficient values in the pixels of at least one color is different from an arrangement of the dither coefficient values for the pixels of other colors.

12. The method for driving a self-luminescent display panel according to claim 10, wherein control is performed so that the number of lit subframes will be different between an odd-numbered minor frame and an even-numbered minor frame when the brightness level is a−1 or a, assuming that a is an integer satisfying $0<a<N$, and a luminescence center-of-gravity subframe is provided for adjustment of a shift of a luminescence center-of-gravity between the odd-numbered minor frame and the even-numbered minor frame which is generated by said control.

13. The method for driving a self-luminescent display panel according to claim 8, wherein said self-luminescent display panel is provided with luminescent elements of a plurality of colors, and an arrangement of the dither coefficient values in the pixels of at least one color is different from an arrangement of the dither coefficient values for the pixels of other colors.

14. The method for driving a self-luminescent display panel according to claim 8, wherein the self-luminescent display panel is provided with a conversion table recorded correspondence relation between pixel data for display and the subframe and, the number of lit subframes is controlled by using different conversion tables for the odd-numbered minor frames and the even-numbered minor frames, a luminescence center-of-gravity subframe period is provided with either the odd-numbered minor frames or the even-numbered minor frames for adjustment of a shift of a luminescence center-of-gravity between the odd-numbered frame and the even-numbered minor frame which is generated by the control.

15. The method for driving a self-luminescent display panel according to claim 14, wherein a reverse bias voltage is applied to at least a part of the luminescent elements in the luminescence center-of-gravity subframe period.

16. The method for driving a self-luminescent display panel according to claim 14, wherein an equi-potential reset of setting both poles of a luminescent element to have an equal potential is performed on at least a part of the luminescent elements in the luminescence center-of-gravity subframe period.

* * * * *